US008771612B2

(12) United States Patent
Fukuoka et al.

(10) Patent No.: US 8,771,612 B2
(45) Date of Patent: Jul. 8, 2014

(54) PHOTORESPONSIVE GAS-GENERATING MATERIAL, MICROPUMP AND MICROFLUID DEVICE

(75) Inventors: Masateru Fukuoka, Osaka (JP); Kazuki Yamamoto, Kyoto (JP); Yoshinori Akagi, Osaka (JP); Hiroji Fukui, Kouka (JP)

(73) Assignee: Sekisui Chemical Co., Ltd., Osaka (JP)

( * ) Notice: Subject to any disclaimer, the term of this patent is extended or adjusted under 35 U.S.C. 154(b) by 355 days.

(21) Appl. No.: 12/920,884

(22) PCT Filed: Mar. 11, 2009

(86) PCT No.: PCT/JP2009/054622

§ 371 (c)(1), (2), (4) Date: Sep. 3, 2010

(87) PCT Pub. No.: WO2009/113566

PCT Pub. Date: Sep. 17, 2009

(65) Prior Publication Data

US 2011/0014096 A1 Jan. 20, 2011

(30) Foreign Application Priority Data

Mar. 11, 2008 (JP) ..... 2008-061290
Sep. 1, 2008 (JP) ..... 2008-223331

(51) Int. Cl.
*B01L 3/00* (2006.01)
*C06B 45/10* (2006.01)
*C06B 45/12* (2006.01)

(52) U.S. Cl.
USPC ..... 422/504; 422/501; 422/503; 261/35; 417/55; 417/118; 435/288.5; 137/807

(58) Field of Classification Search
None
See application file for complete search history.

(56) References Cited

U.S. PATENT DOCUMENTS 3,489,670 A 1/1970 Maget
4,235,236 A * 11/1980 Theeuwes ..... 604/892.1
2004/0198922 A1* 10/2004 Adegawa ..... 525/390
2005/0213910 A1* 9/2005 Chang et al. ..... 385/128

(Continued)

FOREIGN PATENT DOCUMENTS

EP 1 992 402 A1 11/2008
JP 54-92944 A 7/1979

(Continued)

OTHER PUBLICATIONS

International Search Report for the Application No. PCT/JP2009/054622 mailed May 19, 2009.

(Continued)

*Primary Examiner* — Jill Warden
*Assistant Examiner* — Timothy G Kingan
(74) *Attorney, Agent, or Firm* — Cheng Law Group, PLLC

(57) ABSTRACT

The present invention provides a photoresponsive gas-generating material that is to be used in a micropump of a microfluid device having fine channels formed therein, and is capable of effectively generating gases for transporting a microfluid in response to light irradiation and transporting the microfluid at an improved transport efficiency. The present invention also provides a micropump incorporating the photoresponsive gas-generating material.

A photoresponsive gas-generating material 13 is to be used in a micropump having fine channels formed in a substrate, and comprises a photo-sensitive acid-generating agent and an acid-sensitive gas-generating agent, and a micropump 10 has the photoresponsive gas-generating material 13 housed therein.

12 Claims, 5 Drawing Sheets

(56) References Cited

U.S. PATENT DOCUMENTS

| | | | | |
|---|---|---|---|---|
| 2005/0232817 | A1* | 10/2005 | Ahn et al. | 422/99 |
| 2007/0071866 | A1* | 3/2007 | Cox et al. | 426/565 |
| 2009/0126516 | A1* | 5/2009 | Yamamoto et al. | 73/864.22 |

FOREIGN PATENT DOCUMENTS

| | | | | |
|---|---|---|---|---|
| JP | 10-10088 | A | 1/1998 | |
| JP | 2001-132646 | A | 5/2001 | |
| JP | 2002-21715 | A | 12/2002 | |
| JP | 2002-363531 | A | 12/2002 | |
| JP | 2003-146790 | A | 5/2003 | |
| JP | 2005-297102 | A | 10/2005 | |
| JP | 2005-297155 | A | 10/2005 | |
| JP | 2005-300425 | A | 10/2005 | |
| JP | 2005-314298 | A | 11/2005 | |
| JP | 2006-249025 | A | 9/2006 | |
| JP | 2007-264502 | A | 10/2007 | |
| JP | 2007-279069 | A | 10/2007 | |
| WO | WO 2007/105584 | * | 9/2007 | B01F 5/00 |

OTHER PUBLICATIONS

International Preliminary Report on Patentability for Application No. PCT/JP2009/054622 mailed Nov. 11, 2010.

* cited by examiner (a)

(b)

PHOTORESPONSIVE GAS-GENERATING MATERIAL, MICROPUMP AND MICROFLUID DEVICE

TECHNICAL FIELD

The present invention relates to a photoresponsive gas-generating material used in a micropump of a microfluid device with fine channels formed therein, and more specifically an photoresponsive gas-generating material capable of generating gases for transporting a microfluid in response to light irradiation and transporting the microfluid at an improved transport efficiency. The present invention also relates to a micropump and a microfluid device incorporating the photoresponsive gas-generating material.

BACKGROUND ART

In recent years, the size of analysis devices of various fields has been reduced. For example, a smaller-sized crystal inspection device is strongly demanded for bedside diagnosis in which diagnosis is made near a patient. Smaller-sized analysis devices are also strongly demanded for analysis of environmental pollutants in the air, water, or soil because these devices are used outdoors for such analysis.

Microfluid devices attract attention because of their potential to fit such needs. The microfluid devices have a substrate, for example, with a hand-portable and easy-handling size. The substrate has a plurality of fine channels formed therein to transport a reagent, a diluting solution, an analyte, and the like. The substrate is optionally provided therein with parts connected to the fine microchannels such as a reagent storage unit, an analyte supply unit, a diluting solution storage unit, a reaction chamber and a mixing unit.

The size of the microfluid devices have been reduced, and their substrates commonly have a size with planar area of about 1000 $cm^2$ or less, and a thickness of about 0.5 mm to 10 mm. Therefore, the diameter of the fine channels formed in the inside of the substrate is commonly as remarkably thin as about 5 μm to 1 mm. If the channels are flat, the diameter of the fine channels is defined as the narrower width in the cross-section of the flat channels.

Since the microfluid such as the analyte, the diluting solution, or the reagent is transported through such channels with a remarkably small diameter, the microfluid is further more susceptible to factors such as the surface tension of the fluid and the wettability of the wall surfaces of the fine channels, unlike in conventional circuits in which a usual liquid is transported. Accordingly, various parts of such microfluid devices have been studied in various ways.

A method for forming a micropump in a substrate of such a microfluid device has been studied. The micropump is a driving source for transporting a microfluid in such fine channels as described above, and is typically a remarkably small pump having a total volume of 1 $cm^3$ or less. For example, Patent Document 1 discloses a micropump having a remarkably small diaphragm structure provided by the MEMS processing technology. Patent Document 2 discloses a micropump that intermittently transports a liquid by a minute piston. Patent Document 3 discloses a pump that transports a liquid by an electroosmotic flow generated on fine channels. Patent Document 4 discloses a micropump of a hydrogen pump with a solid electrolyte used therein.

Patent Document 5 discloses a micropump in which a micropump chamber provided in a substrate is filled with a material that generates a gas in response to heat or light. In this case, the gas is generated by supplying thermal energy to or irradiating with light the material that generates a gas in response to heat or light in the micropump chamber. The pressure of the generated gas allows a microfluid in fine channels to be transported. Patent Document 5 recites that the material that generates a gas in response to heat or light is a polyoxyalkylene resin whose oxygen content is 15 to 55% by weight.

Patent Document 1: JP-A 2001-132646
Patent Document 2: JP-A 2002-021715
Patent Document 3: JP-A 10-10088
Patent Document 4: U.S. Pat. No. 3,489,670
Patent Document 5: JP-A 2005-297102

DISCLOSURE OF THE INVENTION

Micropumps of various types as disclosed in Patent Documents 1 to 4 has a complex structure, and thus reduction of their size is difficult. In particular, the pumps described in Patent Documents 1 and 2, which have a diaphragm structure or a minute piston used therein, not only has difficulty in reduction of their size but also problematically cause pulsation of a microfluid to be transported due to their mechanical structures.

The hydrogen pump with a solid electrolyte used therein of Patent Document 4 has disadvantages that assembling processes thereof are complicated, and that routing of conductive wires, gas channels and the like is largely restricted. Therefore, it is difficult to mount a large number of the pumps in a substrate of a microfluid device at high mounting density.

On the other hand, the micropump described in Patent Document 5 does not require a complex mechanical structure and a conductive wire because the material that generates a gas in response to heat or light generates a gas when irradiated with light. Accordingly, the micropump can be designed to have a simple and small structure, and thereby the pumps can be mounted at high density. In addition, processing of the substrate of the microfluid device to form the pump is easy because all that is required is only formation of the micropump chamber to be filled with the material that generates a gas in response to light.

The micropump described in Patent Document 5, however, is formed with a polyoxyalkylene resin whose oxygen content is 15 to 55% by weight, and thereby problematically requires irradiation with high intensity light in order to provide a sufficient gas pressure, or takes a longer time before driving a fluid.

If the compound that generates a gas is an azo compound, the pump causes a problem of bad storage stability. This is because the azo compound is decomposed with either light or heat and unfavorably generates a gas when temperature rises high during storage thereof.

In light of above-mentioned problems of the prior art, an object of the present invention is to provide a photoresponsive gas-generating material, which is to be used in a micropump of a microfluid device having a fine channel formed therein, and capable of effectively generating gases in response to light irradiation and transporting a microfluid with improved transport efficiency. Another object of the present invention is to provide a micropump and a microfluid device incorporating the photoresponsive gas-generating material.

The first aspect of the present invention provides a photoresponsive gas-generating material to be used in a micropump of a microfluid device having a fine channel formed in a substrate, comprising: a photo-sensitive acid-generating agent; and an acid-sensitive gas-generating agent.

Examples of the photo-sensitive acid-generating agent used in the present invention include various compounds capable of generating an acid in response to light irradiation. The photo-sensitive acid-generating agent is preferably at least one selected from the group consisting of quinone diazide compounds, onium salts, sulfonate esters, and organic halogenated compounds, and particularly preferably at least one selected from the group consisting of quinone diazide compounds, onium sulfonate salts, benzyl sulfonate esters, halogenated isocyanurates, and bisaryl sulfonyl diazomethanes. These photo-sensitive acid-generating agents are effectively decomposed when irradiated with light, and generate a strong acid such as sulfonic acid. Since the generated acid effectively reacts with the acid-sensitive gas-generating agent, the gas generation efficiency can be further improved.

The acid-sensitive gas-generating agent used in the present invention is preferably a carbonate and/or bicarbonate because the carbonate and/or bicarbonate more effectively generates gases in response to the acid stimulation.

The second aspect of the present invention provides a photoresponsive gas-generating material to be used in a micropump of a microfluid device having a fine channel formed in a substrate, comprising: at least one photo-sensitive base-generating agent (A) selected from the group consisting of cobalt amine complexes, o-nitrobenzyl carbamate, oxime esters, carbamoyloxy imino group-containing compounds capable of generating an amine in response to light irradiation and represented by formula (1), and salts of carboxylic acids (a1) represented by formula (2) and basic compounds (a2); and a base multiplier (B).

[Chem. 1]

Formula (1)

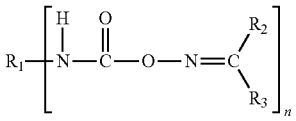

In formula (1), $R_1$ represents an n-valent organic group; $R_2$ and $R_3$ individually represent a hydrogen, an aromatic group, or an aliphatic group, and may be the same as or different from each other; and n is an integer of 1 or more.

[Chem. 2]

Formula (2)

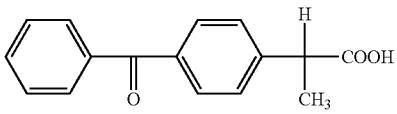

As the photoresponsive gas-generating material of the second aspect of the present invention comprises the photo-sensitive base-generating agent (A) and the base multiplier (B), and thereby immediately and effectively generates gases when irradiated with light.

Accordingly, the photo-sensitive base-generating agent (A) is decomposed when irradiated with light, and generates a gaseous base (hereinafter, abbreviated as "base gas"), carbon dioxide, and alkyl radicals. Consequently, equivalent amounts of the two kinds of gases simultaneously generate, which leads to rapid and effective gas generation. In addition, the base gas reacts with the base multiplier (B), and thereby the base gas is successively generated. The base gas generated by the reaction of the base multiplier (B) acts as a self-catalyst to yield the base gas so that the base gas is generated at an exponential rate. In addition, carbon dioxide is also simultaneously generated. Accordingly, it is possible to further more immediately generate a large amount of the gases.

A microfluid device of the present invention has a fine channel formed in a substrate, and comprises: a first plate having at least two of the micropumps built in the substrate; and a second plate laminated on the first plate and having a groove or a through hole to constitute a fine channel, and the micropump has as a driving source the photoresponsive gas-generating material prepared according to the present invention.

The photoresponsive gas-generating material of the present invention (hereinafter, the first and second aspects are generically referred to as the present invention) may be processed into a tablet, fine particle or film form.

The photoresponsive gas-generating material of the present invention may further comprise a binder resin. The binder resin contained therein facilitates processing of the photoresponsive gas-generating material into a tablet, fine particle or film form. The binder resin can firmly maintain the shape of the photoresponsive gas-generating material.

In the present invention, the weight average molecular weight of the binder resin is preferably in the range of 50,000 to 1,000,000. The binder resin is preferably photodegradable. The photodegradable binder resin enables further more efficient gas generation.

The binder resin preferably has an adhesion property. Use of such a binder resin provides the photoresponsive gas-generating material with the adhesion property, and thereby the photoresponsive gas-generating material can be easily disposed, for example, on a micropump constituting part. For example, when a film-form photoresponsive gas-generating material having the adhesive property is used, the film-form photoresponsive gas-generating material can be easily attached to the substrate surface of the microfluid device or the wall surface in the substrate.

The photoresponsive gas-generating material of the present invention preferably further comprises a photosensitizer. With the photosensitizer, gases are generated more immediately in response to light irradiation.

The photoresponsive gas-generating material of the present invention may comprise a supporting member for supporting the photoresponsive gas-generating material. In this case, the photoresponsive gas-generating material may or may not comprise the binder resin.

The supporting member of the present invention may be a porous member. In this case, gases generated in response to light irradiation are immediately released from the photoresponsive gas-generating material through a plurality of pores of the porous member. Accordingly, it is possible to effectively improve the liquid-transport efficiency of a micropump device.

The porous member may be a fibrous member formed by a plurality of fibers combined together. In this case, generated gases are immediately released through braided space in the fibrous member. When the fibrous member is a planar member, generated gases are immediately released through the braided space on the surface of the planar member.

The supporting member may be made of a nonwoven fabric. In this case, the photoresponsive gas-generating material may be attached to the surface of the nonwoven fabric. With this structure, gases are immediately released from the photoresponsive gas-generating material attached to the nonwoven fabric, and thereby it is possible to more immediately release gases generated in the inside compared to the case where only the photoresponsive gas-generating material is used. Therefore, it is possible to improve the liquid-transport efficiency of the micropump.

The micropump of the present invention is to be used in a microfluid device having a fine channel in a substrate, and the photoresponsive gas-generating material of the present invention is housed in the micropump.

In a specific aspect of the micropump of the present invention, a gas-generating chamber is provided in the substrate, an optical window is provided on one surface of the substrate to face the gas-generating chamber, and the photoresponsive gas-generating material is housed in the gas-generating chamber.

In another specific aspect of the micropump of the present invention, the photoresponsive gas-generating material is in a film form, a gas-generating unit having an opening on a surface of the substrate is provided on the substrate to define the micropump, and the film-form photoresponsive gas-generating material is attached on the surface of the substrate so that the gas-generating unit is sealed with the film-form photoresponsive gas-generating material.

In still another specific aspect of the micropump of the present invention, depressions and projections are formed on a part of the surface of the substrate covered with the photoresponsive gas-generating material.

The microfluid device of the present invention comprises a micropump to be used in a microfluid device having a fine channel formed in a substrate; a first plate having at least two of the micropumps built therein; and a second plate laminated on the first plate and having a groove or a through hole to constitute the fine channel, and the micropump houses the photoresponsive gas-generating material of the present invention.

In a specific aspect of the microfluid device of the present invention, at least two gas-generating chambers are provided in the first plate, optical windows are provided on one surface of the first plate to face the gas-generating chambers, and at least one of the photoresponsive gas-generating material, the photoresponsive gas-generating fine particulate material, and the film-form photoresponsive gas-generating material is housed in the gas-generating chambers.

In another specific aspect of the microfluid device of the present invention, the photoresponsive gas-generating material has a plurality of the fine channels, and further comprises a light shielding layer extending over openings of the fine channels adjacent to each other in a plain view and shielding the gas-generating unit from light.

EFFECT OF THE INVENTION

According to the first aspect of the present invention, since the photoresponsive gas-generating material contains a photo-sensitive acid-generating agent and an acid-sensitive gas-generating agent, the photo-sensitive acid-generating agent is decomposed when irradiated with light and generates an acid. In addition, the acid reacts with the acid-sensitive gas-generating agent. Accordingly, it is possible to immediately generate gases from the acid-sensitive gas-generating agent. Therefore, the use of the photoresponsive gas-generating material of the present invention in a micropump of a microfluid device enables transportation of a microfluid and improvement of the liquid-transport efficiency.

According to the photoresponsive gas-generating material of the second aspect of the present invention, it is possible to effectively generate gases by irradiation with light. For example, when light energy required to decompose a 1-mol photo-sensitive base-generating agent is provided, 2 mol or more of the base gas and 2 mol of carbon dioxide are generated, resulting in improvement of the gas-generating efficiency. In addition, the reaction of the photoresponsive gas-generating material in response to light rapidly proceeds in a chain reaction manner, which in turn enables reduction of time until generation of gases.

According to the present invention, the photoresponsive gas-generating materials of the first or second aspect of the present invention are stable against heat, and thereby the storage stability thereof is favorable.

Therefore, a micropump incorporating the photoresponsive gas-generating material of the present invention can transport a liquid at an improved transport efficiency. A microfluid device having the micropump built therein can also transport a liquid at an improved transport efficiency, and thereby enables operations of analysis and the like to rapidly proceed.

EXPLANATION OF SYMBOLS

Figure 1:
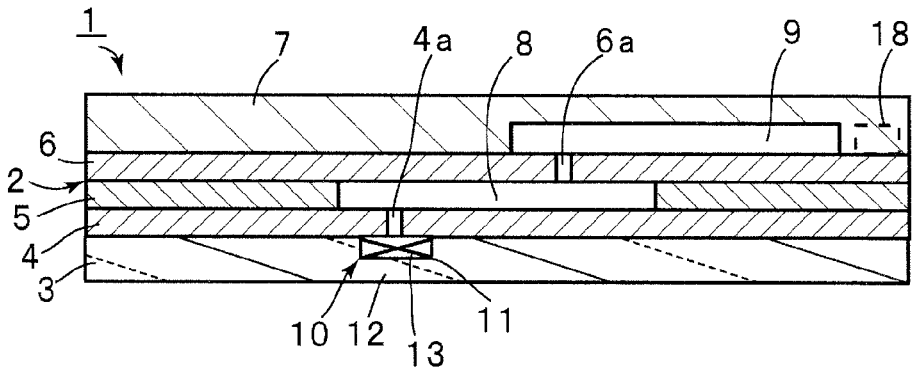
FIG. 1 (*a*) is a schematic frontal cross-sectional view of a microfluid device having a micropump of a first embodiment of the present invention, and 1(*b*) is an enlarged partial frontal cross-sectional view illustrating the structure of the micropump.
Figure 1:
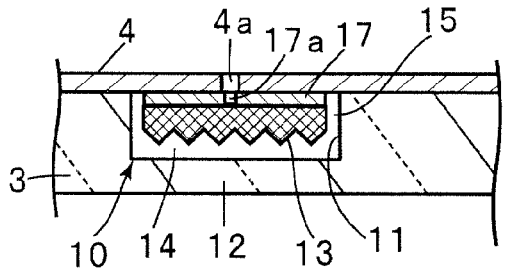

1 Microfluid device
2 Substrate
3 Base plate
4 to 6 Intermediate plate
4*a* Through hole
6*a* Through hole
7 Top plate
8, 9 Fine channel
10 Micropump
11 Gas-generating chamber
12 Optical window
13 Photoresponsive gas-generating material
14 Channel
17 Reflecting member
17*a* Through hole
18 Measurement cell
20 Micropump
21 Photoresponsive gas-generating material

31 Microfluid device
32 Substrate
33 Base plate
33*a* Through hole
33*b*, 33*c* Groove
34 Intermediate plate
34*a* Through hole
34*b* Groove
35 Top plate
36 Photoresponsive gas-generating member
37 Gas barrier layer
38, 39 Shielding layer
102A Substrate
103A Base plate
104A to 106A Intermediate plate
107A Top plate
108,109 Fine channel
110 Micropump
111 Gas-generating chamber
112 Optical window
113 Photoresponsive gas-generating material
131 Micro chemical chip
210 Substrate
210*a* Surface
210*c* Groove
214 Microchannel
214*a* Opening
220 Gas-generating layer
220*a* Communication hole
220*b* Groove
221 Barrier layer
221*a* Peripheral part

BEST MODE FOR CARRYING OUT THE INVENTION

[Photoresponsive Gas-Generating Material of First Aspect of the Invention]

The photoresponsive gas-generating material of the first aspect of the present invention contains a photo-sensitive acid-generating agent and an acid-sensitive gas-generating agent. Since the photoresponsive gas-generating material of the present invention contains the photo-sensitive acid-generating agent and the acid-sensitive gas-generating agent, the photoresponsive gas-generating material generates an acid from the photo-sensitive acid-generating agent in response to light irradiation, and the acid reacts with the acid-sensitive gas-generating agent, and immediately generates a gas.

In the present invention, the photo-sensitive acid-generating agent is a compound that generates an acid when irradiated with light. Such photo-sensitive acid-generating agents are already well known, and a conventionally known photo-sensitive acid-generating agent is appropriately used in the present invention.

Specific examples of the photo-sensitive acid-generating agent include quinone diazide compounds, onium salts, sulfonate esters, and organic halogenated compounds.

Among these, at least one selected from the group consisting of quinone diazide compounds, onium sulfonate salts, benzyl sulfonate esters, halogenated isocyanurates, and bisaryl sulfonyl diazomethanes is particularly preferably used as the photo-sensitive acid-generating agent. These photo-sensitive acid-generating agents are efficiently decomposed when irradiated with light, and generates a strong acid such as sulfonic acid. Therefore, use of these photo-sensitive acid-generating agents further improves the gas generation efficiency.

Examples of the quinone diazide compounds include esters of 1,2-naphthoquinone-2-diazido-5-sulfonic acid or 1,2-naphthoquinone-2-diazido-4-sulfonic acid, and a low molecular weight aromatic hydroquinone compound. Examples of the low molecular weight aromatic hydroquinone compound include 1,3,5-trihydroxybenzene, 2,3,4-trihydroxybenzophenone, 2,3,4,4'-tetrahydroxybenzophenone, and cresol. Among them, 1,2-naphthoquinone-2-diazido-5-sulfonic acid-p-cresol ester is preferably used.

Examples of the onium salts include triphenylsulfonium hexafluoroantimonate, and triphenylsulfonium hexafluorophosphate.

Examples of the sulfonate esters include bisaryl sulfonyl diazomethanes, p-nitrobenzyl 9,10-dimethoxyanthracene-2-sulfonate, m-nitrobenzyl 9,10-dimethoxyanthracene-2-sulfonate, m,p-dinitrobenzyl 9,10-dimethoxyanthracene-2-sulfonate, p-cyanobenzyl 9,10-dimethoxyanthracene-2-sulfonate, chlorobenzyl 9,10-dimethoxyanthracene-2-sulfonate, dimethylaminonaphthalene-5-sulfonate, diphenyliodonium-9,10-dimethoxyanthracene-2-sulfonate, 4-methoxyphenyl-phenyliodonium-9,10-dimethoxyanthracene-2-sulfonate, bis(4-methoxyphenyl)iodonium-9,10-dimethoxyanthracene-2-sulfonate, bis(4-t-butylphenyl)iodonium-9,10-dimethoxyanthracene-2-sulfonate, diphenyliodonium-anthracene-2-sulfonate, diphenyliodonium-trifluoromethane sulfonate, and 5-propylsulfonyloxyimino-5H-thiophene-2-ylidene-2-methylphenyl acetonitrile. Diphenyliodonium-9,10-dimethoxyanthracene-2-sulfonate and 5-propylsulfonyloxyimino-5H-thiophene-2-ylidene-2-methylphenyl acetonitrile are preferable among these because they generate an acid at high efficiency in response to light irradiation.

The acid-sensitive gas-generating agent is not particularly limited, provided that it generates a gas in response to stimulation of an acid, that is, an effect of the acid. A carbonate and/or bicarbonate is suitably used.

Examples of the acid-sensitive gas-generating agent include sodium hydrogen carbonate, sodium carbonate, sodium sesquicarbonate, magnesium carbonate, potassium carbonate, potassium hydrogen carbonate, calcium carbonate, and sodium borohydride. These may be used alone, or two or more of these may be used in combination. Sodium carbonate, sodium hydrogen carbonate, and mixtures of sodium carbonate and sodium hydrogen carbonate are more suitable because they are highly stable, and generate a large amount of gases.

The amount of the acid-sensitive gas-generating agent to be used is stoichiometrically equivalent to or more than the amount of an acid to be generated from the photo-sensitive acid-generating agent.

[Photoresponsive Gas-Generating Material of Second Aspect of the Invention]

Photo-Sensitive Base-Generating Agent (A)

The photo-sensitive base-generating agent (A) is decomposed when irradiated with light, and generates a gaseous base. The photo-sensitive base-generating agent (A) is selected from the group consisting of cobalt amine complexes, o-nitrobenzyl carbamate, oxime esters, carbamoyloxy imino group-containing compounds capable of generating an amine in response to light irradiation and represented by formula (1), and salts of carboxylic acids (a1) represented by formula (2) and basic compounds (a2).

[Chem. 3]

Formula (1)

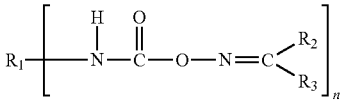

In formula (1), $R_1$ represents an n-valent organic group; $R_2$ and $R_3$ individually represent a hydrogen, an aromatic group, or an aliphatic group; and n is an integer of 1 or more.

[Chem. 4]

Formula (2)

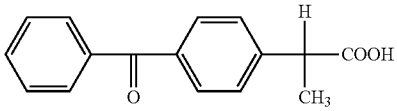

The carbamoyloxy imino group-containing compounds represented by formula (1) are not particularly limited, and examples thereof include compounds produced in the following manner as described in JP-A 2002-138076.

An amount of 0.1 mol of acetophenone oxime dissolved in 100 ml of tetrahydrofuran (THF) is added to 0.05 mol of hexamethylene diisocyanate, and allowed to react for 4 hours at 50° C. in a dry nitrogen atmosphere under stirring. Tetrahydrofuran is volatilized from the reaction liquid to yield a white sold. The obtained white sold is dissolved in methyl ethyl ketone at 80° C., and purified by recrystallization to yield a compound capable of generating an amine in response to light irradiation.

The salts of carboxylic acids (a1) and basic compounds (a2) can be easily prepared only by mixing a carboxylic acid (a1) and a basic compound (a2) in a solution. When the carboxylic acid (a1) and the basic compound (a2) are mixed in a vessel, the acid-base reaction represented by reaction scheme (S1) proceeds to yield a salt A1.

[Chem. 5]

Formula (S1)

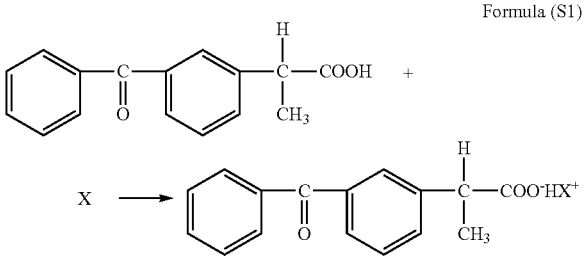

(A1)

In scheme (S1), X is the basic compound (a2), and the salt is indicated by (A1).

The salt thus obtained has a backbone derived from the carboxylic acid (a1), and thereby is easily decarboxylated when irradiated with light, and the reaction represented by reaction scheme (S2) proceeds. Therefore, the salt alone can exhibit excellent photo-decomposition performance. Namely, the salt is decomposed to yield a base gas and carbon dioxide immediately each in a sufficient amount.

[Chem. 6]

Formula (S2)

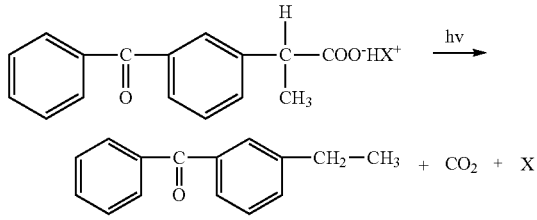

In scheme (S2), X is the basic compound (a2).

The basic compound (a2) is not particularly limited, and examples thereof include amines such as primary amines, secondary amines, and tertiary amines; pyridyl group-containing compounds; hydrazine compounds; amide compounds; quaternary ammonium hydroxide salts; mercapto compounds; sulfide compounds; and phosphine compounds. Two or more of these may be used in combination.

At least one selected from the group consisting of compounds represented by formulas (3) to (8) is suitably used as the basic compound (a2). In this case, the salt is further more immediately decomposed when irradiated with light, resulting in further more immediate generation of the base gas and carbon dioxide.

[Chem. 7]

Formula (3)

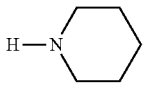

[Chem. 8]

Formula (4)

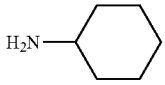

[Chem. 9]

Formula (5)

$(CH_3)_4N^+OH^-$

[Chem. 10]

Formula (6)

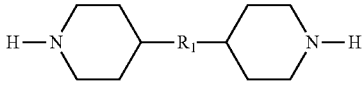

In formula (6), $R_1$ represents a $C_{1-10}$ alkylene chain. Since the base gas is also generated, $R_1$ is preferably a $C_{1-2}$ alkylene chain.

[Chem. 11]

$H_2N—R_2—NH_2$ Formula (7)

In formula (7), $R_2$ represents a $C_{1-10}$ alkylene chain. Since the base gas is also generated, $R_2$ is preferably a $C_{1-2}$ alkylene chain.

[Chem. 12]

Formula (8)

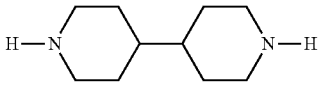

When $R_1$ in formula (6) is a $C_{1-2}$ alkylene chain, or when $R_2$ in formula (7) is a $C_{1-2}$ alkylene chain, the base gas reacts with a base multiplier (B), and the base gas is successively generated. The base gas generated by the reaction of the base multiplier (B) acts as a self-catalyst to yield the base gas so that the base gas is generated at an exponential rate. In addition, carbon dioxide is also simultaneously generated. Therefore, it is possible to further more immediately generate a large amount of the gases.

When $R_1$ in formula (6) is a $C_{3-10}$ alkylene chain, or when $R_2$ in formula (7) is a $C_{3-10}$ alkylene chain, the base multiplier does not generate a base gas due to its large molecular weight. However, the base multiplier has many carboxyl groups in the side chains, and thereby can immediately and effectively generate carbon dioxide.

Base Multiplier (B)

Since the base multiplier (B) is blended in the present invention, it is possible to generate the base gas at an exponential rate as described above. The base multiplier (B) is not particularly limited, and a 9-fluorenyl carbamate derivative is preferably used. The 9-fluorenyl carbamate derivative may be any of bifunctional type, spherical polyfunctional oligomer type, linear polymer type, and siloxane type.

The base multiplier (B) is preferably a base multiplier (B1) having a base multiplying group represented by formula (9).

[Chem. 13]

Formula (9)

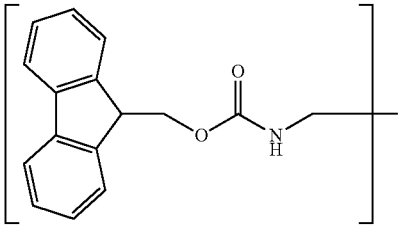

The base multiplier (B1) having a base multiplying group represented by formula (9) is decomposed in the base multiplication reaction and generates amines. The generated amines act as additional catalysts, and produce a large number of amines at an exponential rate. With a larger number of the base multiplying groups represented by formula (9) in the molecule, the base multiplication reaction in the molecule more efficiently occurs. Therefore, a larger number of amino groups are produced.

In the base multiplication reaction involving the base multiplier (B1) having a base multiplying group represented by formula (9), active hydrogen atoms are drawn out by the base to yield a carbanion. Subsequently, carbamic acid is eliminated, and decomposition proceeds to yield amino groups and carbon dioxide. The amino groups act as catalysts to accelerate the reaction. The reaction is represented by reaction scheme (X1).

[Chem. 14]

Formula (X1)

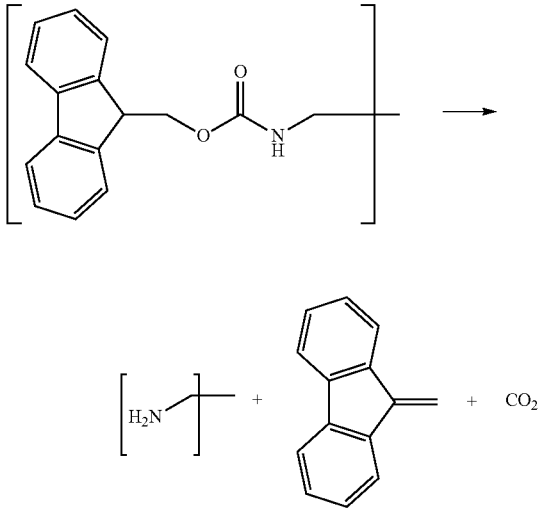

The base multiplying group represented by formula (9) is preferably a base multiplying group represented by formula (10).

[Chem. 15]

Formula (10)

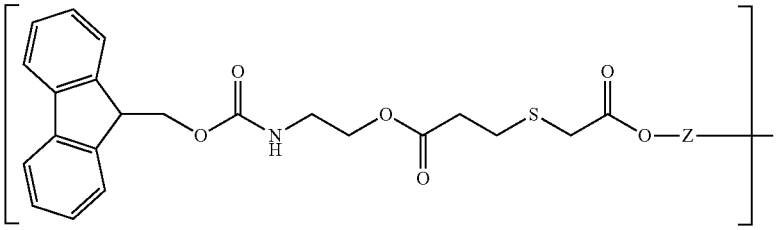

In formula (10), Z represents a substituted or unsubstituted alkylene chain.

Specific examples of Z in formula (10) include methylene chains, ethylene chains, and propylene chains. For effective base multiplication reaction, Z is preferably an unsubstituted alkylene chain. In order to reduce the steric hindrance in Z, and to allow the base multiplication reaction to further more effectively occur, Z is preferably a methylene chain among these.

The base multiplier having a base multiplying group represented by formula (10) is preferably a base multiplier represented by formula (11).

[Chem. 16]

Formula (11)

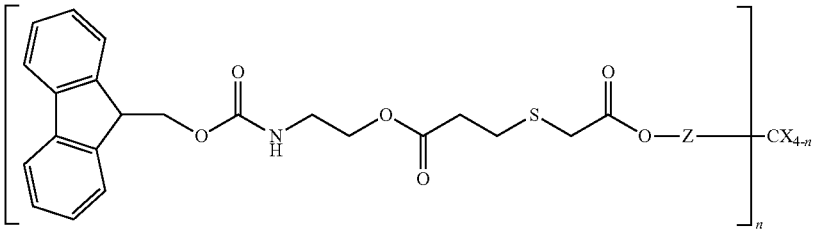

In formula (11), X represents a hydrogen atom, a substituted or unsubstituted alkyl group, Z represents a substituted or unsubstituted alkylene chain, and n is an integer of 1 to 4.

Specific examples of X in formula (11) include methylene chains, ethylene chains, and propylene chains. For effective base multiplication reaction, X is preferably an unsubstituted alkylene chain. For reduction of the steric hindrance in X, and for more effective base multiplication reaction, X is preferably a methylene chain among these.

In formula (11), n is an integer of 1 to 4. When the base multiplier represented by formula (11) has a plurality of 9-fluorenyl carbamate groups in one molecule, the base multiplication reaction may further more effectively occur owing to the catalytic action of the generated base. In formula (11), n is preferably an integer of 3 or 4.

Specific examples of the base multiplier represented by formula (11) include base multipliers (Flu3) represented by formula (12) and base multiplier (Flu4) represented by formula (13). The base multipliers represented by formulas (12) and (13) can be prepared in a manner conventionally known in the art.

[Chem. 17]

Formula (12)

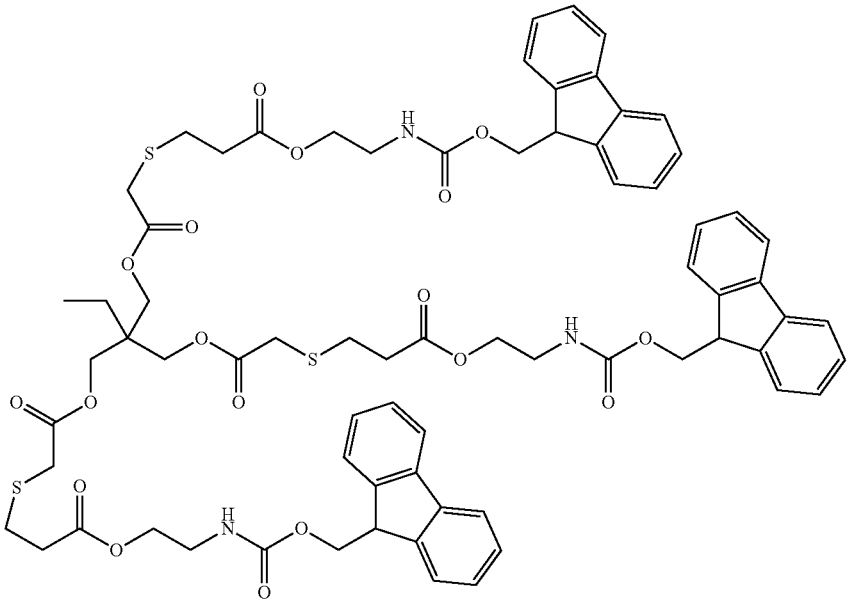

Flu3

-continued

[Chem. 18]

Formula (13)

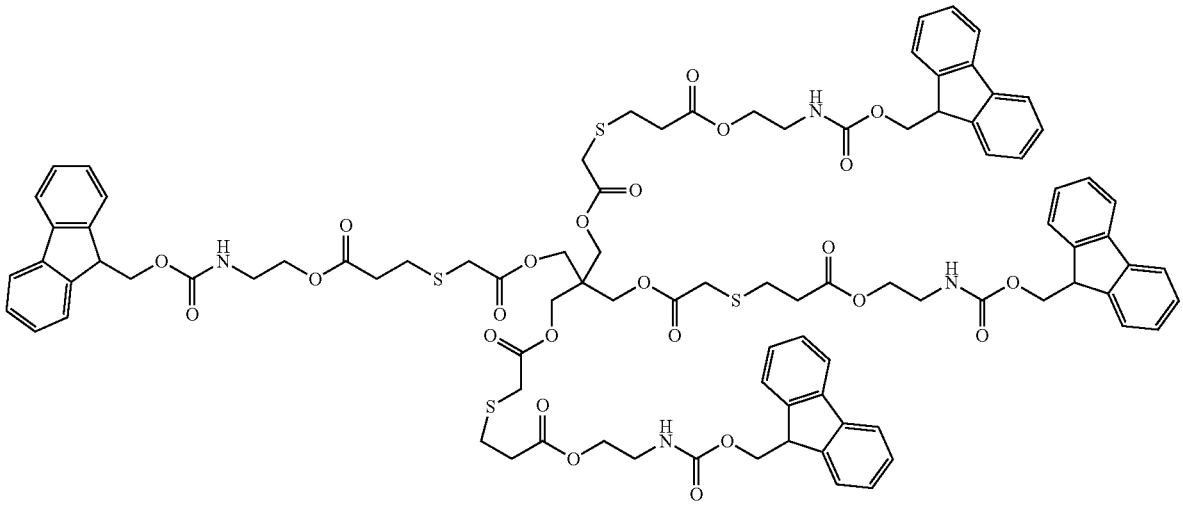

Flu4

The base multipliers represented by formulas (12) and (13) have a plurality of 9-fluorenyl carbamate groups in one molecule. With this structure, the base multiplication reaction easily proceeds owing to the catalytic action of the generated base. The base multipliers represented by formula (12) are more preferable, and the base multipliers represented by formula (13) are further more preferable because these base multipliers further more improve the generation efficiency of the base.

The base multipliers having a base multiplying group represented by formula (9) or (10) and the base multipliers represented by formulas (11), (12) and (13) are not particularly limited, and may be synthesized by, for example, an addition reaction of fluorenyl methanol and an isocyanate derivative, or an addition reaction of an acrylate monomer having a fluorenyl carbamate group and a polythiol derivative. For easy synthesis, a tin catalyst is suitably used in the former addition reaction, and a base catalyst is suitably used in the latter addition reaction.

Base multiplying groups represented by formula (14) are also preferable as the base multiplying group represented by formula (9).

[Chem. 19]

Formula (14)

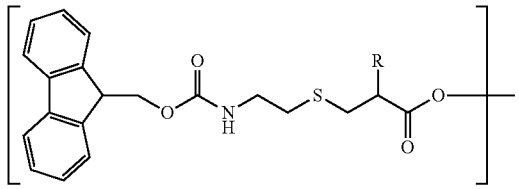

In formula (14), R represents a hydrogen atom or a methyl group.

As the base multiplier (B1) having a base multiplying group represented by formula (9), a base multiplier having a base multiplying group represented by formula (14) and an unsaturated group represented by formula (15) is also more preferably used.

[Chem. 20]

Formula (15)

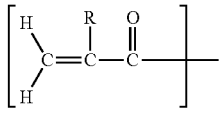

In formula (15), R represents a hydrogen atom or a methyl group.

A base multiplier having a base multiplying group represented by formula (14) and an unsaturated group represented by formula (15) is also more preferably used.

The base multiplier having a base multiplying group represented by formula (14) may be prepared by, for example, an addition reaction of the compound having an unsaturated group represented by formula (15) and 9-fluorenyl methyl N-(2-mercapto ethyl) carbamate as represented in reaction scheme (X2). In the addition reaction, R in formula (14) is derived from R in the unsaturated group represented by formula (15).

[Chem. 21]

Formula (X2)

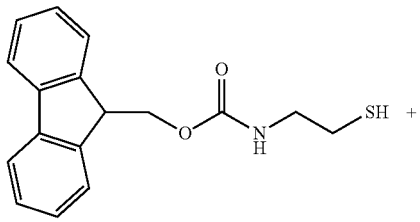

-continued

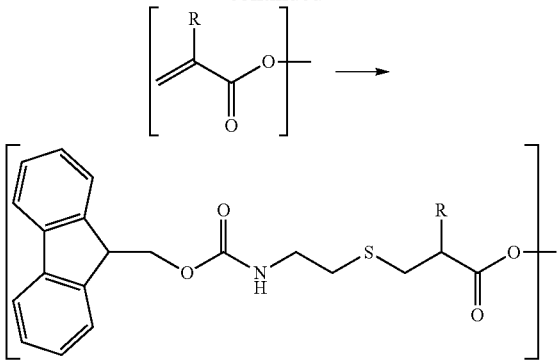

In scheme (X2), R represents a hydrogen atom or a methyl group.

The compound having an unsaturated group represented by formula (15) is a compound having an acrylate group or a methacrylate group (hereinafter, both are generically referred to as (meth)acrylate group).

Examples of the compound having an unsaturated group represented by formula (15) include (meth)acrylate monomers and oligomers. When the base multiplier has base multiplying groups represented by formula (15) as many as possible in one molecule, the base multiplying reaction more effectively occurs. For this reason, monomers and oligomers having at least two (meth)acrylate groups are preferable.

Specific examples of the polyfunctional (meth)acrylate monomers and (meth)acrylate oligomers include ethylene di(meth)acrylate, triethylene glycol di(meth)acrylate, epoxy acrylate, and analogues thereof.

For example, a novolac compound or a known dendritic polyfunctional (meth)acrylate may also be used. These may be used alone, or a mixture of these may be used.

In order to increase the number of the base multiplying groups represented by formula (14) in one molecule of the base multiplier, a compound having at least two unsaturated groups represented by formula (15) may be used.

The compound having at least two unsaturated groups represented by formula (15) may be synthesized by the Michael addition reaction of the α-thioglycerin to a compound having unsaturated groups represented by formula (15) to convert the unsaturated groups into diol-substituted groups represented by formula (16), and etherification or urethanization of each hydroxyl group. In this reaction, for example, one unsaturated group can be transformed into two or four unsaturated groups.

[Chem. 22]

Formula (16)

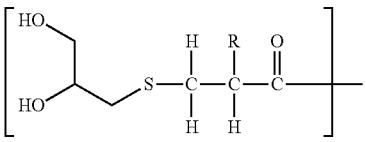

In formula (16), R represents a hydrogen atom or a methyl group.

An etherification method and a urethanization method can be used in order to introduce a (meth)acrylate group, which is an unsaturated group, into the hydroxyl groups of the polyol compound having groups represented by formula (16).

The amount of the base multiplier (B) to be used is preferably in the range of 50 to 200 parts by weight with respect to 100 parts by weight of the photo-sensitive base-generating agent (A). When the amount of the of the base multiplier (B) is less than 50 parts by weight, the chain reaction involving the base multiplier reaction may not efficiently occur. When the amount of the base multiplier (B) is more than 200 parts by weight, the base multiplier may be saturated in a solvent, resulting in precipitation of the base multiplier. The reaction may be hard to control because the chain reaction is dominant in the whole reaction, and therefore, the reaction may not be stopped as desired.

Amino Alkyl Compound (C)

An amino alkyl compound (C) reacts with the alkyl radicals generated by decomposition of the photo-sensitive base-generating agent (A). The base gas is generated also in this reaction. Therefore, use of the amino alkyl compound further improves the gas generation efficiency. In addition, the generated base gas reacts with the base multiplier (B) to yield the base gas at a higher exponential rate. Simultaneously, carbon dioxide is also generated upon generation of the base gas. Therefore, use of the amino alkyl compound (C) in addition to the base multiplier (B) further improves the gas generation efficiency.

The amino alkyl compound (C) is not particularly limited, and is suitably one compound selected from the group consisting of methylamine, ethylamine, butylamine, N-methylaminoethyl, N,N-dimethylaminoethyl, N,N-diethylethylenediamine, and N-methylaminobutyl. Use of this compound further improves the gas generation efficiency.

The photoresponsive gas-generating material of the second aspect of the present invention preferably further contains the amino alkyl compound (C) in a ratio of 20 to 100 parts by weight with respect to 100 parts by weight of the photo-sensitive base-generating agent (A). When the amino alkyl compound (C) is used at a level of lower than 20 parts by weight, an effect produced by addition of the amino alkyl compound (C) may not be sufficiently obtained. Since the amount of the radicals generated from the photo-sensitive base-generating agent is equivalent to the amount of the photo-sensitive base-generating agent, more than 100 parts by weight of the amino alkyl compound (C) is too much with respect to the radical so that portion of the amino alkyl compound (C) may remain unreacted. For this reason, more than 100 parts by weight of the amino alkyl compound (C) is not necessary.

Since the photoresponsive gas-generating material of the second aspect of the present invention contains the photo-sensitive base-generating agent (A), the photoresponsive gas-generating material generates a sufficient amount of the base gas even when not containing a photosensitizer and even when irradiated with a small amount of light in a short time.

The photoresponsive gas-generating material of the present invention does not generate a gas at common storage temperature, and generates the gas in response to light irradiation. Namely, the thermal stability thereof is excellent In the present invention, the photoresponsive gas-generating material may be in a tablet, fine particle or film form.

[Binder Resin]

In the present invention, the photoresponsive gas-generating material may further comprise a binder resin. In this case, the photoresponsive gas-generating material may be easily processed into a tablet, fine particle or film form. The binder resin enables the photoresponsive gas-generating material to firmly maintain its shape.

The binder resin is not particularly limited, and examples thereof include polymer materials such as poly(meth)acrylics, polyesters, polyethylenes, polypropylenes, polystyrenes, polyethers, polyurethanes, polycarbonates, polyamides, and polyimides. Alternatively, copolymers of these may be used. These may be used in combination. Poly(meth)acrylates are preferable among these because they further improve the gas generation efficiency. The ultraviolet absorption band of the binder resin is preferably shorter than the ultraviolet absorption bands of the photo-sensitive acid-generating agent, the photosensitizer, and the photo-sensitive base-generating agent.

(Meth)acrylate monomers used to produce the poly(meth) acrylics may be chain compounds or cyclic compounds. Examples of the chain compounds include methyl(meth) acrylate, ethylacrylate, butyl(meth)acrylate, 2-methylhexyl (meth)acrylate, and lauryl(meth)acrylate. Examples of the cyclic compounds include cyclohexyl(meth)acrylate and isoboronyl(meth)acrylate. Methyl(meth)acrylate is preferable among these.

The poly(meth) acrylics may be prepared by, for example, copolymerizing the (meth)acrylate monomer and a vinyl monomer copolymerizable with the (meth)acrylate monomer.

The vinyl monomer copolymerizable with the (meth)acrylate monomer is not particularly limited, and examples thereof include carboxyl group-containing vinyl monomers such as (meth)acrylic acid, itaconic acid, crotonic acid, maleic anhydride, fumaric anhydride, and carboxyalkyl (meth)acrylate including carboxyethyl acrylate; hydroxy group-containing vinyl monomers such as 2-hydroxyethyl (meth)acrylate, 2-hydroxypropyl(meth)acrylate, 4-hydroxybutyl(meth)acrylate, caprolactone modified (meth)acrylate, and polyethylene glycol(meth)acrylate; and nitrogen-containing vinyl monomers such as (meth)acrylonitrile, N-vinyl pyrrolidone, N-vinyl caprolactam, N-vinyl laurolactam, (meth)acryloyl morpholine, (meth)acrylamide, dimethyl (meth)acrylamide, N-methylol(meth)acrylamide, N-butoxymethyl(meth)acrylamide, N-isopropyl(meth)acrylamide, and dimethylaminomethyl(meth)acrylate. These vinyl monomers may be used alone, or two or more of these may be used in combination.

The combination of the (meth)acrylate monomer and the vinyl monomer is not particularly limited, and examples thereof include [methyl(meth)acrylate and (meth)acrylic acid], [methyl(meth)acrylate and (meth)acrylamide], and [(meth)acrylic acid and N-isopropyl(meth)acrylamide].

The copolymerization ratio (weight ratio) of the (meth) acrylate monomer and the vinyl monomer is preferably in the range of (98:2) to (51:49).

As the poly(meth)acrylates, at least one selected from the group consisting of polymethyl(meth)acrylate, a copolymer of methyl(meth)acrylate and (meth)acrylic acid and a copolymer of methyl(meth)acrylate and (meth)acrylamide is preferable because they further improve the gas generation efficiency. The poly(meth)acrylate preferably has an amino group or a carbonyl group in order to further improve the gas generation efficiency.

The binder resin may be photodegradable in order to further improve the gas generation efficiency.

The weight average molecular weight of the binder resin is preferably in the range of 50,000 to 1,000,000, and more preferably 100,000 to 500,000. When a binder resin having an excessively small weight average molecular weight is used, the cohesive force of the binder resin is low, and thereby the photo-sensitive acid-generating agent or the acid-sensitive gas-generating agent, or the photo-sensitive base-generating agent or the base multiplier may not be firmly combined. When a binder resin having an excessively large weight average molecular weight is used, processability of the photoresponsive gas-generating material into various forms may be deteriorated.

The binder resin is preferably a resin having an adhesion property. In this case, the photoresponsive gas-generating material is provided with the adhesion property so that the photoresponsive gas-generating material is easily disposed on, for example, the micropump. For example, a film-form photoresponsive gas-generating material having the adhesion property can be easily attached to the surface of the substrate of the microfluid device or the wall of the inside of the substrate.

When the binder resin is used in the first aspect of the present invention, the photo-sensitive acid-generating agent is preferably contained in a ratio of 10 to 300 parts by weight, and more preferably in a ratio of 50 to 200 parts by weight with respect to 100 parts by weight of the binder resin. The acid-sensitive gas-generating agent is preferably contained in a ratio of 10 to 300 parts by weight, and more preferably in a ratio of 50 to 200 parts by weight with respect to 100 parts by weight of the binder resin. When the amounts of the photo-sensitive acid-generating agent and the acid-sensitive gas-generating agent are excessively small, sufficient amounts of gases may not be generated in response to light irradiation. When these amounts are excessively large, the photo-sensitive acid-generating agent and the acid-sensitive gas-generating agent may not be efficiently dispersed in or attached to the binder resin, and thereby form powdery materials, resulting in pollution of microchannels.

In the second aspect of the present invention, the photo-sensitive base-generating agent (A) is preferably contained in a ratio of 20 to 500 parts by weight, and more preferably in a ratio of 100 to 300 parts by weight with respect to 100 parts by weight of the binder resin. When the amount of the photo-sensitive base-generating agent (A) is excessively small, the gases may not be sufficiently generated in response to light irradiation. When the amount of the photo-sensitive base-generating agent (A) is excessively large, the photo-sensitive base-generating agent (A) may not be efficiently dispersed in or attached to the binder resin, and thereby form powdery materials, resulting in pollution of the microchannel.

The base multiplier (B) is preferably contained in a ratio of 10 to 1000 parts by weight, more preferably in a ratio of 50 to 500 parts by weight with respect to 100 parts by weight of the binder resin. When the amount of the base multiplier (B) is excessively small, the chain reaction involving the base multiplication reaction may not efficiently occur. When the amount of the base multiplier (B) is excessively large, the reaction may be hard to control because the chain reaction is dominant in the whole reaction, and therefore, the reaction may not be stopped as desired.

The photoresponsive gas-generating material of the present invention is preferably in a tablet, fine particle or film form. The photoresponsive gas-generating material is particularly preferably in a tablet form because the photoresponsive gas-generating material in this form is easy to handle. Processing of the photoresponsive gas-generating material into a tablet form requires a smaller amount of the binder resin compared to processing it into a film form so that it is possible to achieve high gas generation efficiency.

Examples of a method for processing the photoresponsive gas-generating material into a tablet form include a pressing method.

The amount of the binder resin to be used may be appropriately determined according to the form of the photoresponsive gas-generating material. When the photoresponsive gas-generating material is processed into, for example, a tablet or fine particulate form, the amount of the binder resin is preferably as small as possible but enough to maintain the shape of the photoresponsive gas-generating material, and more preferably the binder resin is not used. Even when the binder resin is used, the amount of the binder resin is preferably as small as when it is used as a binder. In this case, the binder resin is preferably blended in a ratio of 0 to 20 parts by weight, more preferably in a ratio of 0 to 10 parts by weight with respect to 100 parts by weight of the total amount of the photo-sensitive acid-generating agent and the acid-sensitive gas-generating agent, or the photo-sensitive base-generating agent (A) and the base multiplier (B).

This is because the gas yield is made higher when the photoresponsive gas-generating material contains the photo-sensitive acid-generating agent and the acid-sensitive gas-generating agent, or the photo-sensitive base-generating agent (A) and the base multiplier (B), which generate gases, in as large amounts as possible compared to the amount of the binder resin.

When the photoresponsive gas-generating material is processed into a photoresponsive gas-generating fine particulate material, the respective components blended in the photoresponsive gas-generating material may be separately formed into fine particles, or two or more of these are mixed and formed into fine particles. Especially, it is preferable that at least the photo-sensitive acid-generating agent and the acid-sensitive gas-generating agent together, and the photo-sensitive base-generating agent and the base multiplier together are formed into fine particles. Use of the photoresponsive gas-generating fine particulate material improves the gas generation efficiency from the fine particulate material after light irradiation, and allows the generated gases to easily pass therethrough owing to the space between the fine particles. The particle size of the photoresponsive gas-generating fine particulate material is not particularly limited, and is preferably 50 μm to 2 mm. The photoresponsive gas-generating material may be processed into a fine particulate material by blending the components with the binder resin, and, for example, spotting appropriate portions of the blended composition in a poor solvent to yield fine particles having a desired particle size.

The photoresponsive gas-generating material processed into a film or tape form is easy to handle. Conventional micropump systems require a micropump chamber to be formed in a substrate, and thereby the production processes of these micropump systems tend to be complicated. In contrast, the photoresponsive gas-generating material processed into a film or tape form can be, for example, attached to the substrate to form a micropump, and thereby enables simplification of the production processes of the micropump, and also enables further reduction of the size of the micropump.

The photoresponsive gas-generating material may be formed into a film form in a common manner using the binder resin. The thickness of the photoresponsive gas-generating film is not particularly limited, and is preferably 1 to 200 μm, and more preferably 5 to 100 μm. The photoresponsive gas-generating film is preferably transparent.

[Photosensitizer]

The photoresponsive gas-generating material of the present invention preferably further comprises a photosensitizer. When photoresponsive gas-generating material comprises the photosensitizer, the gases can be more immediately generated in response to light irradiation.

The photosensitizer is not particularly limited, provided that it transfers energy to the photo-sensitive acid-generating agent or the photo-sensitive base-generating agent, and promotes decomposition of the photo-sensitive acid-generating agent or the photo-sensitive base-generating agent. Examples thereof include thioxanthone, benzophenone, acetophenones, Michler's ketone, benzyl, benzoin, benzoin ether, benzyl dimethylketal, benzoil benzylate, α-acyloxy esters, tetramethylthiuram monosulfide, aliphatic amines, aromatic group-containing amines, cyclic compounds having a nitrogen as a member of the ring such as piperidine, allylthiourea, o-tolyl thiourea, sodium diethyl dithiophosphate, soluble salts of aromatic sulfinic acids, N,N-disubstituted-p-aminobenzonitrile compounds, tri-n-butylphosphine, N-nitroso hydroxylamine derivatives, oxazolidine compounds, tetrahydro-1,3-oxazine compounds, condensed compounds of a diamine and formaldehyde or acetaldehyde, anthracene (or its derivatives), xanthin, N-phenylglycine, and cyanine pigment porphyrins (or derivatives thereof) such as phthalocyanine, naphthocyanine, and thiocyanine. These photosensitizers may be used alone, or two or more of these may be used in combination.

When the photosensitizer is used, the blending ratio of the photosensitizer is not particularly limited, and is preferably in the range of 0.1 to 100 parts by weight with respect to 100 parts by weigh of the photo-sensitive acid-generating agent or the photo-sensitive base-generating agent in order to provide sufficient photosensitization effect. The more preferable range is 1 to 50 parts by weight, and the further more preferable range is 1 to 10 parts by weight. When the amount of the photosensitizer is excessively small, sufficient photosensitization effect may not be obtained. When it is excessively large, the photosensitization effect reaches a certain level from which the photosensitization effect is no longer enhanced, or the photodecomposition of the photo-sensitive acid-generating agent or the photo-sensitive base-generating agent may be suppressed. Use of the photosensitizer allows use of a light source of a long wavelength area (300 nm or higher).

In the present invention, the photoresponsive gas-generating material may be supported by a supporting member. The micropump may be provided with a photoresponsive gas-generating member having the photoresponsive gas-generating material and a supporting member for supporting the photoresponsive gas-generating material. When the supporting member is used to support the photoresponsive gas-generating material, the binder resin may be or may not be contained.

As the supporting member, an appropriate supporting member that immediately releases generated gases can be used.

The supporting member may be formed with a fibrous member such as cotton. When the supporting member made of a fibrous member is used, generated gases are immediately released to the outside through the space between the fibers. When the supporting member made of a fibrous member is used, the photoresponsive gas-generating material may be supported by the supporting member by impregnating the fibrous member with the photoresponsive gas-generating material.

The supporting member may be, for example, an appropriate combined and entangled fibrous member formed with synthetic fibers, such as glass fibers, PET fibers (polyethylene terephthalate) or acrylic fibers, pulp fibers, or metal fibers.

The supporting member is not particularly limited, provided that it allows generated gases to be immediately released to the outside, and examples thereof include various porous members. Here, the porous members include variety of members having a large number of holes connected each other on the outer surface, and members having space between fibers extending to the outside such as cotton are also included in the porous members.

Examples of the porous members of the supporting member other than the fibrous members include porous members having a large number of holes connected each other from the inside to the outer surface such as sponges, foam breaking treated foams, porous gels, particle fused bodies, molded bodies whose thickness is expanded with the help of gas pressure, honeycomb structural bodies, cylindrical beads, and waveform chips.

The materials of the supporting member are not particularly limited, and various inorganic materials or organic materials may be used. Examples of the inorganic materials include glass, ceramics, metals, and metal oxides. Examples of the organic materials include polyolefins, polyurethanes, polyesters, nylons, cellulose, acetal resins, acrylics, PET (polyethylene terephthalate), polyamides, and polyimides.

[Other Components]

For the purpose of assisting generation of gases, stopping sequential gas generation, or assisting penetration into the porous supporting member, the photoresponsive gas-generating material may optionally contain additives such as a photodegradable azo compound, a peroxide, a radical scavenger, and a solvent The azo compound is not particularly limited, and examples thereof include azo amide compounds, azonitrile compounds, azo amidine compounds, and cyclic azo amidine compounds. Azo compounds other than these listed above may be used. These azo compounds may be used alone, or two or more of these may be used in combination. In particular, an azo compound having a large number of ketone groups and amide groups tends to electrostatically bond with the binder resin owing to high polarity of the azo compound. Therefore, it is possible to further improve the gas generation efficiency.

The peroxide is not particularly limited, and examples thereof include benzoyl peroxide and di-t-butyl peroxide. Other examples thereof include isoamyl o-dimethylaminobenzoate; anthraquinones such as 2-ethylanthraquinone, octamethylanthraquinone, 1,2-benzanthraquinone, and 2,3-diphenylanthraquinone; triazines such as 2,4-trichloromethyl-(4'-methoxyphenyl)-6-triazine, 2,4-trichloromethyl-(4'-methoxynaphthyl)-6-triazine, 2,4-trichloromethyl-(4'-methoxystyryl)-6-triazine; azobisisobutyronitrile; benzoyl peroxide; and cumene peroxide.

The radical scavenger is not particularly limited, and examples thereof include t-butylcatechol, hydroquinone, methyl ether, catalase, glutathione peroxidase, superoxide dismutase enzymes, vitamin C, vitamin E, polyphenols, and linolenic acid.

The solvent is not particularly limited, provided that it dissolves the photo-sensitive acid-generating agent, the acid-sensitive gas-generating agent, the photo-sensitive base-generating agent, the base multiplier, and the binder resin. Specific examples thereof include glycol ethers such as dimethoxyethane, ethylene glycol methylethyl ether, 2-methoxy ethanol, and 2-ethoxy ethanol; ethylene glycol alkyl ether acetates such as methyl cellosolve acetate and ethyl cellosolve acetate; diethylene glycol derivatives such as diethylene glycol monomethyl ether, diethylene glycol monoethyl ether, diethylene glycol dimethyl ether, diethylene glycol diethyl ether, diethylene glycol monopropyl ether, diethylene glycol dipropyl ether, diethylene glycol monobutyl ether, and diethylene glycol dibutyl ether; propylene glycol derivatives such as propylene glycol methylethyl ether; ketones such as methyl amyl ketone and cyclohexanone; esters such as ethoxy ethyl acetate, ethyl hydroxyacetate, and ethyl lactate; and aprotic bipolar solvents such as N-methylpyrrolidone, N,N-dimethylacetamide, and γ-butyrolactone.

The photoresponsive gas-generating material of the present invention may optionally further contain conventionally known various additives. Examples of the additives include coupling agents, leveling agents, plasticizers, surfactants, and stabilizers.

Hereinafter, specific embodiments of the micropump of the present invention are described by reference to the figures.

Light irradiated to a gas-generating layer 20 is not particularly limited, provided that it has a wavelength to be absorbed by the gas-generating agent or the photosensitizer. However, the light is preferably ultraviolet light having a wavelength of 10 nm to 400 nm, or blue light having a wavelength of 400 nm to 420 nm near ultraviolet light, and is more preferably near ultraviolet light having a wavelength of 300 nm to 400 nm.

A light source used for light irradiation of the gas-generating layer 20 is not particularly limited. Specific examples of the light source include low pressure mercury lamps, middle pressure mercury lamps, high pressure mercury lamps, ultra-high pressure mercury lamps, light emitting diodes (LEDs), all-solid lasers, chemical lamps, black light lamps, microwave-excited mercury lamps, metal halide lamps, sodium lamps, halogen lamps, xenon lamps, and fluorescent lamps. Light emitting devices such as light emitting diodes (LEDs) are preferable among these because they generate less heat, and are available at low cost.

First Embodiment

FIG. 1 (*a*) is a schematic front cross-sectional view of a microfluid device provided with a micropump of the first embodiment of the present invention, and 1(*b*) is an enlarged partial front cross-sectional view illustrating the structure of the micropump.

As shown in FIG. 1 (*a*), a microfluid device 1 has a substrate 2 having a plurality of plates laminated on one another. The substrate 2 has a base plate 3, intermediate plates 4 to 6 laminated on the base plate 3, and a top plate 7 laminated on the intermediate plate 6. The lamination structure of the substrate 2 is not limited to this.

A plurality of fine channels 8 and 9 are formed in the substrate 2. The fine channel 9 is connected to a reagent storage unit and an analyte feeding unit although they are not shown in the figures. The fine channel 8 is connected to a micropump chamber 10. As shown in FIGS. 1 (*a*) and (*b*), the micropump chamber 10 is formed in the substrate 2. More specifically, in the present embodiment, the base plate 3 is provided with a gas-generating chamber 11 having an open on the upper surface of the base plate 3. An optical window 12 is formed on the lower surface of the gas-generating chamber 11. The optical window 12 is made of a material that is passed through by irradiation light to a photoresponsive gas-generating material described below to generate light.

In the present embodiment, the base plate 3 is a transparent member, and the optical window 12 is formed by the transparent member of the base plate 3 to be integrally incorporated in the base plate 3. The transparent member may be made of a glass or a transparent synthetic resin, and materials thereof are not particularly limited.

The materials of the intermediate plates 4 to 6, the top plate 7, and the like other than the base plate 3 of the substrate 2 may be appropriate materials such as synthetic resins.

The optical window 12 may be formed with a material different from that of the base plate 3. Namely, an opening is formed in a part of the base plates 3, and the transparent member that constitutes the optical window 12 may be fixed on the opening to hermetically seal the gas-generating chamber 11. With this structure, it is possible to avoid stray light by coloring the base plate, and even when a plurality of micropumps are arranged, it is possible to positively control each of them without errors.

The gas-generating chamber 11 may have a downward opening in the base plate 3, and the optical window 12 may be formed by laminating another transparent plate on the lower surface of the base plate 3.

In this case, the transparent plate that constitutes the optical window may be painted or attached with a film in order to shield the part other than the optical window.

The gas-generating chamber 11 has an opening on the upper surface of the base plate 3. The photoresponsive gas-generating member 13 is housed in the gas-generating chamber 11.

The planar shape of the gas-generating chamber 11 is not particularly limited, and may be an appropriate shape such as circle or rectangle. The depth of the gas-generating chamber 11 is not particularly limited, provided that it can house the photoresponsive gas-generating member 13.

As the gas-generating chamber 11 needs to define a small micropump, the preferable size thereof is commonly about 400 $mm^2$ or less in planer area, and about 0.5 mm to 10 mm in depth. The more preferable planar area is about 9 $mm^2$ or less, and the more preferable depth is about 1 mm to 1.5 mm. When the micropump is required to produce more power, a plurality of the gas-generating chambers may be connected to each other.

The photoresponsive gas-generating member 13 has a supporting member having a photoresponsive gas-generating material attached thereto. The photoresponsive gas-generating member 13 may be produced by, for example, impregnating the supporting member with the photoresponsive gas-generating material, and drying it in a darkroom. The photoresponsive gas-generating member 13 may have a porous structure formed by foaming of the supporting member. The supporting member may not be integrally formed, and a plurality of supporting members may be housed in the gas-generating chamber. In order to increase the surface area, fine particles may be added to the supporting member.

The supporting member is preferably constituted by a porous member containing the above-mentioned fibrous member, and more preferably a porous member having a gas flow path in form of a hole formed by connected holes from the surface on the optical window 12 side to the opposite side to the side where the optical window 12 is formed. In this case, heat generated in the outside is more immediately released toward the fine channel 8.

In the micropump 10 of the present embodiment, the photoresponsive gas-generating material 13 is attached to the supporting member, and thereby gases generated in response to light irradiation are immediately released through the outer surface of the photoresponsive gas-generating member 13. Accordingly, it is possible to strikingly improve the gas generation efficiency, for example, by 10 or more times compared to the case where masses of the photoresponsive gas-generating material are housed.

The light used to generate gases is not particularly limited, provided that it has a wavelength to be absorbed by the photosensitive acid-generating agent, the photo-sensitive base-generating agent, or the photosensitizer. The light is preferably ultraviolet light having a wavelength of 10 to 400 nm or blue light having a wavelength of 400 to 420 nm near ultraviolet light, and is more preferably near ultraviolet light having a wavelength of 300 nm to 400 nm. As a light source, a light emitting device such as a commercially available low-cost 380-nm LED may be used.

In the photoresponsive gas-generating member 13, the photoresponsive gas-generating material is attached to the surface of the supporting member. It is preferable that, as shown in FIG. 1 (*a*), an air layer 14 is formed between the photoresponsive gas-generating member 13 and the optical window 12. With the air layer 14, generated gases are immediately discharged through the space of the air layer 14 to the fine channel 8. It is more preferable that, as shown in FIG. 1 (*b*), a gas flow path 15 is formed in the outside of the side face of the photoresponsive gas-generating member 13 so that the air layer 14 provided between the optical window 12 and the photoresponsive gas-generating member 13 is connected to a through hole 4*a* formed in the intermediate plate 4. In this structure, the planar area of the photoresponsive gas-generating member 13 is preferably smaller than the planar area of the gas-generating chamber 11.

In the present embodiment, the photoresponsive gas-generating member 13 has a plurality of depressions and projections formed on the surface on the optical window 12 side. With this structure, the volume of the air layer 14 is increased. Accordingly, it is preferable to provide such depressions and projections.

In the present embodiment, the photoresponsive gas-generating member 13 is provided with a reflecting member 17 on the surface on the side opposite to the optical window 12. The reflecting member 17 is formed by an appropriate reflexive material that reflects light irradiated through the optical window 12. A metal, a mirror, or the like may be used as the reflexive material. A metal foil, a metal vapor deposition film, or the like may be preferably used because they are thin and allow the microfluid device to be low-profile. A metal foil such as an aluminum foil is preferably suitably used because it is highly reflexive and available at low cost. Vapor-deposition of a suitable metal such as Al or a suitable alloy forms a thinner reflecting layer.

The thickness of the reflecting member 17 is not particularly limited, and is preferably smaller. When the reflecting member 17 is made of a metal foil, the thickness of the reflecting member 17 may be about 1 μm to 500 μm. When the reflecting member 17 is made of a thin film formed by a thin-film formation method such as a vapor deposition film, the thickness thereof may be about 1 μm or less.

The reflecting member needs to have a through hole 17*a* formed therein. The through hole 17*a* is formed at a position to overlap a discharge hole 16. With the through hole 17*a*, it is possible to discharge generated gases to the through hole 4*a* through the through hole 17*a*. The through hole 4*a* is formed in the intermediate plate 4, and connected to the fine channel 8. The fine channel 8 is formed by providing in the intermediate plate 5*a* through opening of a size according to the channel width. The through opening is closed by the intermediate plate 4 located below and the intermediate plate 6 located above, and thereby the fine channel 8 is defined. The fine channel 8 is connected to the through hole 6*a* for connection formed in the intermediate plate 6. The through hole 6*a* for connection has an opening to the fine channel 9. The size of the through hole for connection is preferably 5 to 20 μm, which allows gases to pass therethrough but does not allow fluids to pass therethrough. The through hole 6*a* for connection may be partitioned by [AKOUSHITSU]. The fine channel 9 is formed by forming depressions on the lower surface of the top plate 7 according to the planar shape of the fine channel 9.

In the microfluid device, as described above, the fine channels have a remarkably small width of about 5 μm to 1 mm, and thereby a microfluid to be transport along the fine channels is largely susceptible to the surface tension between the inner surfaces of the substrate 2, and also is largely susceptible to the capillarity. Accordingly, the microfluid may show a behavior different from that in large-size channels in common fluid circuits. In the microfluid device 1, the microfluid may occupy the entire area of the cross-section of the channel at a part of the channel in the length direction, but air layers are present in front and back of the fluid. Namely, the microfluid is transported in a droplet form. With this structure, it is possible to quickly transport droplets along the microchannel owing to the excluded volume effect of gases gushed from the micropump 10. In this case, in order to quickly transport the microfluid, it is preferable that the pressure of gases from the micropump 10 rapidly increases.

In the micropump 10 of the present embodiment, as described above, the photoresponsive gas-generating member 13 has a structure in which the photoresponsive gas-generating material is attached to the supporting member, and allows gases to be immediately released to the outside. Therefore, it is possible to rapidly increase the gas pressure when gases are generated in response to light irradiation. In addition, as the reflection member 17 is provided, it is possible to effectively utilize light, and thereby to improve the liquid-transport efficiency of the micropump 10.

Therefore, it is possible to improve the gas-generation efficiency and response even when using the same amount of the photoresponsive gas-generating material. In turn, it is possible to reduce the size of the micropump 10 and also to reduce the size of the entire microfluid device 1.

In the above-mentioned embodiment, the photoresponsive gas-generating member 13 is attached to the surface of the supporting member. However, the photoresponsive gas-generating material may not be necessarily attached to the supporting member. Namely, in the micropump 10 of the first embodiment, only the photoresponsive gas-generating material of the present invention may be housed in the gas-generating chamber 11 in stead of the photoresponsive gas-generating member 13. A micropump device of the second embodiment of the present invention is formed using a micropump device having the same structure as that of the first embodiment other than the above-described structure. In this case, the reflecting member 17 is disposed on the side of the photoresponsive gas-generating member opposite to the optical window 12 as in the first embodiment. Owing to the reflecting member 17, it is possible to effectively utilize light, and thereby to improve the liquid-transport efficiency of the micropump.

When the supporting member is not used, the photoresponsive gas-generating material may be applied in minute droplet form to an application part such as the inside of the gas-generating chamber 11 using a jet dispenser or an ink-jet device. The photoresponsive gas-generating fine particulate material and/or the photoresponsive gas-generating film may be housed in the gas-generating chamber 11 instead of or in addition to the photoresponsive gas-generating material.

In order to describe a modified example of the first embodiment of the present invention, the description of the structure of the micropump 10 of the first embodiment other than the supporting member is used. For description of a micropump 20 of a modified example described below by referring to FIG. 2 and description of the microfluid device 1, the description of the micropump of the first embodiment of the present invention is used. Namely, the second embodiment of the present invention can also be modified as in the similar way to the following modified examples, and can be applied to the following microfluid device 1.

Figure 2:
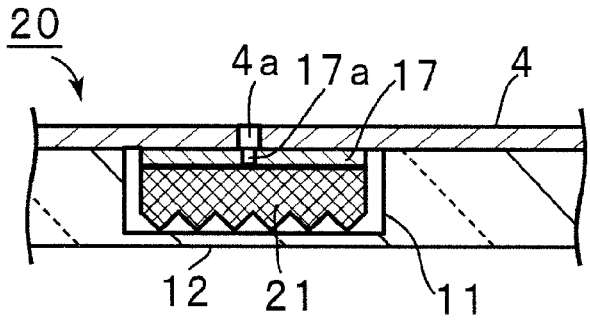
FIG. 2 is a partial frontal cross-sectional view illustrating a modified example of a micropump device having the micropump of the present invention.

FIG. 2 is a partial frontal cross-sectional view schematically illustrating a modified example of the micropump 10 of the first embodiment. In the micropump 20 of this modified example, a photoresponsive gas-generating member 21 contacts the optical window 12 at a plurality of points. Namely, in this modified embodiment, the photoresponsive gas-generating member 21 has depressions and projections on the optical window 12 side, and thereby has a shape with a plurality of projecting parts sequentially arranged as in the first embodiment. The plurality of projecting parts contacts the inner surface of the optical window 12 at the plurality of apexes of the projecting parts. Therefore, the photoresponsive gas-generating member 21 contacts the inner surface of the optical window 12 at the plurality of points. In this case, spaces for releasing gases, that is, air layers, are formed in the plurality of depressed parts between the projecting parts, and thereby it is possible to immediately release generated gases. In addition, since the plurality of projecting parts of the photoresponsive gas-generating members 21 are in contact with the inner surface of the optical window 12 at the plurality of points, the photoresponsive gas-generating member 21 hardly moves in the gas-generating chamber 11, and thereby the air layers between the projecting parts are positively secured even when, for example, the microfluid device 1 is brought out and exposed to vibration or external force. Deformation and the like caused by movement of the photoresponsive gas-generating member 21 hardly occurs because the photoresponsive gas-generating member 21 hardly moves in the gas-generating chamber 11. Therefore, the reliability of the micropump 20 is improved.

As described above, the microfluid device 1 has the fine channels 8 and 9 in the substrate 2 along which a microfluid is transported, and a measurement cell 18 indicated by the dashed line in FIG. 1 (*a*) is connected to the fine channel 9. In the measurement cell 18, a microfluid transported from the fine channel 9 is analyzed by an optical detection method, an electrochemical detection method, or the like. As the measurement cell, a cell for housing a liquid analyte may be formed for optical measurement, or a measurement cell suitable for another appropriate method of detecting an analyte in the measurement cell may be formed.

The microfluid device 1 is optionally provided with a dilution unit for diluting an analyte, a mixing unit for mixing, and the like in addition to the measurement cell. Such a structure can be optionally modified based on the structures of conventionally known microfluid devices.

In the micropumps 10 and 20, a gas yield is preferably 1 mL or more per gram of the photoresponsive gas-generating material, and more preferably 1.5 mL or more under the condition that the photoresponsive gas-generating material housed in the micropump is irradiated with 380-nm ultraviolet light for 200 seconds at an irradiation intensity of 24 $mW/cm^2$. At a gas yield of 1.0 mL per gram of the photoresponsive gas-generating material or more, the liquid-transport efficiency is further improved. At a gas yield of 1.5 mL or more, the liquid-transport efficiency is further more improved.

In the microfluid device 1, the single micropump 10 that houses the photoresponsive gas-generating member 13 having the photoresponsive gas-generating material of the present invention is built in the base plate 3. A plurality of the micropumps 10 may be built in the base plate 3. In this case, the fine channels are connected to each other by forming, in the intermediate plate 4, through holes 4*a* connected to the plurality of micropumps 10 so that the micropump 10 is allowed to function.

Second Embodiment

Figure 3:
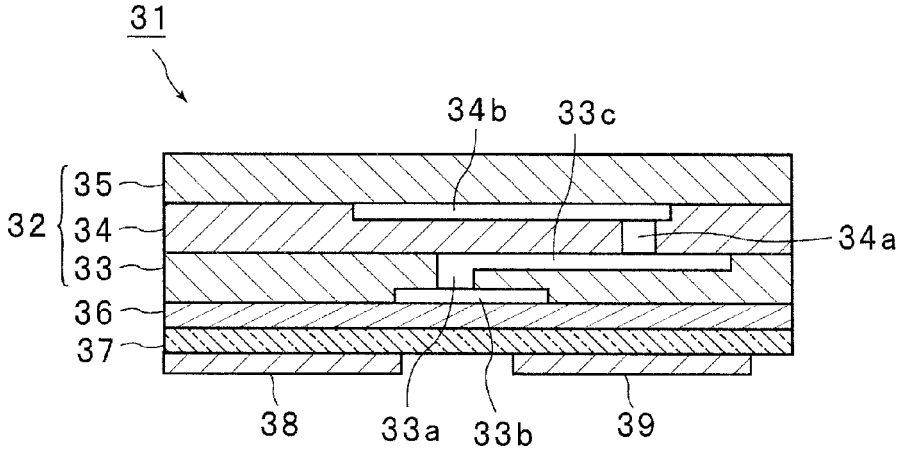
FIG. 3 is a schematic frontal cross-sectional view for illustrating a microfluid device of a second embodiment of the present invention.

FIG. 3 is a schematic front cross-sectional view of a microfluid device of the second embodiment of the present invention.

As shown in FIG. 3, a microfluid device 31 has a substrate 32. The substrate 32 is formed by laminating a plurality of plates 33 to 35. Specifically, the intermediate plate 34 and the top plate 35 are laminated on the base plate 33. The base plate 33, the intermediate plate 34, and the top plate 35 of the substrate 32 may be formed using the same materials as the substrate materials of the first embodiment. A groove 33*b* is formed on the lower surface of the base plate 33 to be connected to a through hole 33*a* in the base plate 33. A groove 33*c* is formed on the upper surface of the base plate 33 to be connected to the upper end of the through hole 33*a*. A through hole 34*a* and a groove 34*b* connected to the upper end of the through hole 34*a* are formed in intermediate plate 34. The groove 34*b* is closed by the top plate 35.

A film-form photoresponsive gas-generating member 36 is attached to the lower surface of the substrate 32, that is, the lower surface of the base plate 33. The film-form photoresponsive gas-generating member 36 is made of the photoresponsive gas-generating material of the present invention which contains the binder resin and has the adhesion property. Therefore, the film-form photoresponsive gas-generating member 36 can be easily attached to the lower surface of the base plate 33.

The micropump is constituted by the film-form photoresponsive gas-generating member 36 and the groove 33*b* of the base plate 33. Gases are generated when the film-form photoresponsive gas-generating member 36 is irradiated with light. The generated gases are supplied to a microchannel including the through hole 33*a*. The microchannel is a fine channel part including the groove 33*c*, the through hole 34*a*, and the groove 34*b* as well as the through hole 33*a*.

The film-form photoresponsive gas-generating member 36 is made of a single film, but may be formed by laminating a plurality of the film-form photoresponsive gas-generating members. The film-form photoresponsive gas-generating member 36 may be directly formed on the lower surface of the substrate 32.

A gas barrier layer 37 is laminated on the lower surface of the film-form photoresponsive gas-generating member 36. The gas barrier layer 37 is formed to prevent gases generated from the film-form photoresponsive gas-generating member 36 from leaking from the lower surface. Thus, the gas barrier layer 37 is preferably laminated on the surface of the film-form photoresponsive gas-generating material on the side opposite to the gas supply side. With this structure, it is possible to further improve the amount of gases supplied to the microchannel.

The gas barrier layer 37 may be in a film form or a plate form. The gas barrier layer 37 is preferably made of a material that is less likely to allow gases to pass therethrough. The gas barrier layer 37 may be a film or a plate made of a material that is less likely to allow gases to pass therethrough. Examples of the material of the gas barrier layer 51 include polyacrylics, polyolefins, polycarbonates, vinyl chloride resins, ABS resins, polyethylene terephthalate (PET), nylons, urethane resins, polyimides, and glasses.

The gas barrier layer 37 is preferably made of a light-transmitting material. In particular, when the film-form photoresponsive gas-generating member 36 is irradiated with light from the lower surface, a material having excellent transmittance of light that decomposes the photo-sensitive acid-generating agent and the photo-sensitive base-generating agent (A) or has a wavelength so that it is adsorbed by the photosensitizer. When the substrate 32 is transparent, the gas barrier layer 37 may be made of a light non-transmitting material. In this case, light may be allowed to be transmitted from the upper surface of the substrate 32 to generate gases.

In the case of irradiation with light from the lower surface of the gas barrier layer 37, a light shielding layer 38 may be formed in such a manner that only a lower portion of the groove 33*b* constituting the micropump is irradiated with light. The light shielding layer 38 is made of a light shielding material, and is located below the opening part of the groove 33*b*. The materials of such light shielding layers 38 and 39 may be suitable materials that can shield irradiated light or hardly allows irradiated light to pass therethrough.

Third Embodiment

Figure 4:
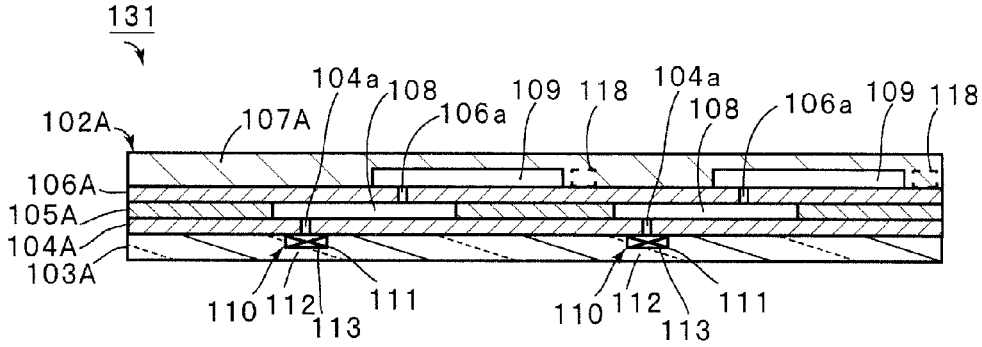
FIG. 4 is a cross-sectional view of a microfluid chip of a third embodiment of the present invention.

FIG. 4 is a front cross-sectional view of a micro chemical chip of a microfluid device of the third embodiment of the present invention.

The micro chemical chip 131 shown in FIG. 4 has a structure in which two of the microfluid devices of the first embodiment are arranged. The micro chemical chip 131 has a base plate 103A as a first plate having two micropumps 110 built therein.

At least two gas-generating chambers 111 are formed in the base plate 103A. Optical windows 112 are formed on one surface of the base plate 103A to face the two gas-generating chambers 111, respectively. The two gas-generating chambers 111 each house a supporting member having a photoresponsive gas-generating material 113 attached thereto. Also in the micro chemical chip 131 shown in FIG. 4, a photoresponsive gas-generating fine particulate material and/or a photoresponsive gas-generating film may be housed in the gas-generating chambers 111 instead of or in addition to the photoresponsive gas-generating material.

A substrate 102A is constituted by a base plate 103A, intermediate plates 104A to 106A, and a top plate 107A. The substrate 102A has a similar structure to that of the substrate of the first embodiment, except that it has the plurality of micropumps 110, and that a plurality of fine channels 108, 109 connected to the plurality of micropumps 110, and measurement cells are formed.

A plurality of the micropumps of the second embodiment shown in FIG. 3 may be formed in the substrate in the similar manner as described above although a plurality of the micropumps of the first embodiment are formed in FIG. 4.

Although the two micropumps 110 are built in the base plate 103A in the micro chemical chip 131, the required number of the micropumps 110 built therein is at least two, therefore three or more micropumps 110 may be built therein.

Fourth Embodiment

Figure 5:
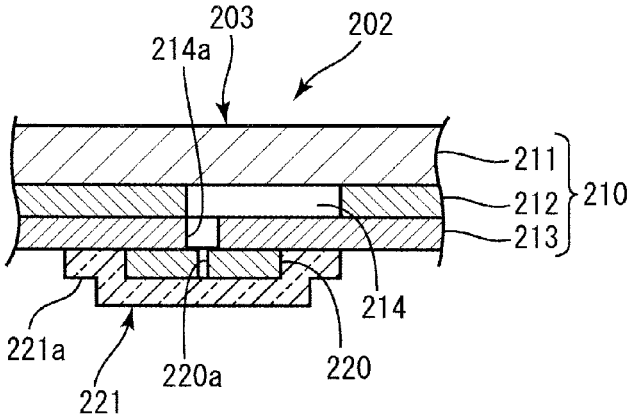
FIG. 5 is a frontal cross-sectional view illustrating a microfluid device of a fourth embodiment of the present invention.

FIG. 5 is a cross-sectional view of a microfluid device of the fourth embodiment. As shown in FIG. 5, in the present embodiment, a barrier layer 221 is attached to a substrate 210 over the entire circumference of a peripheral part 221*a* located in the periphery of a gas-generating layer 220. In this structure, a substantially air-tight space is formed between the substrate 210 and the barrier layer 221. A gas-generating layer 220 is provided in the airtight space.

The gas-generating layer 220 may be adhered or bonded on the substrate 210, or may not be adhered and bonded on the substrate 210. A communicating hole 220*a* is formed in the gas-generating layer 220. The communicating hole 220*a* is connected to an opening 214*a*.

For example, when the communicating hole 220*a* is not formed, gases generated in the surface of the gas-generating layer 220 on the side opposite to the substrate 210 are supplied to a microchannel 214 through the inside of the gas-generating layer 220. With this structure, the gas-transport efficiency to the microchannel 214 tends to be low. On the other hand, in the present embodiment, since the communicating hole 220*a* is formed, gases generated in the surface of the gas-generating layer 220 on the side opposite to the substrate 210 are also supplied to the microchannel 214 through the communicating hole 220*a*. Accordingly, gases can be efficiently supplied to the microchannel 214. Therefore, for example, the gas-generating layer 220 may be designed smaller.

Fifth Embodiment

Figure 6:
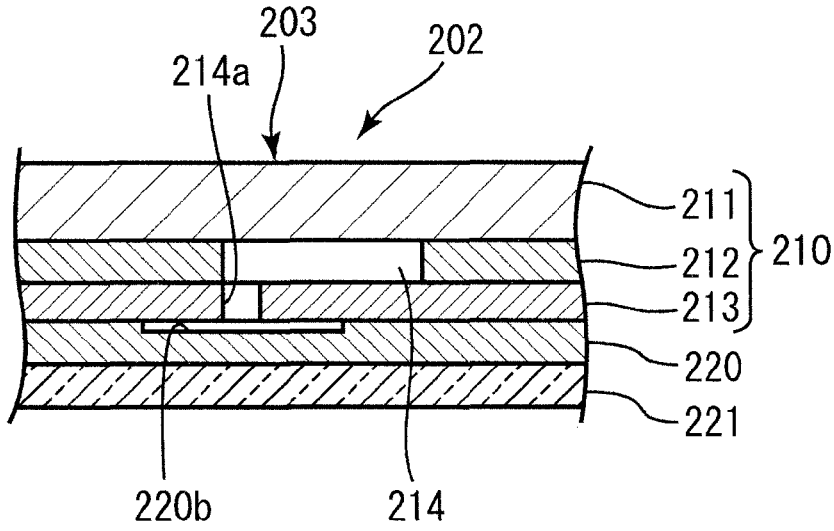
FIG. 6 is a front cross-sectional view illustrating a microfluid device of a fifth embodiment of the present invention.

FIG. 6 is a cross-sectional view of a microfluid device of the fifth embodiment. As shown in FIG. 6, one or more grooves 220*b* each connected to an opening 214*a* may be formed on the gas-generating layer 220. With this structure, it is possible to efficiently supply gases generated in a part distant from the opening 214*a* of the gas-generating layer 220 to the microchannel 214.

Figure 7:
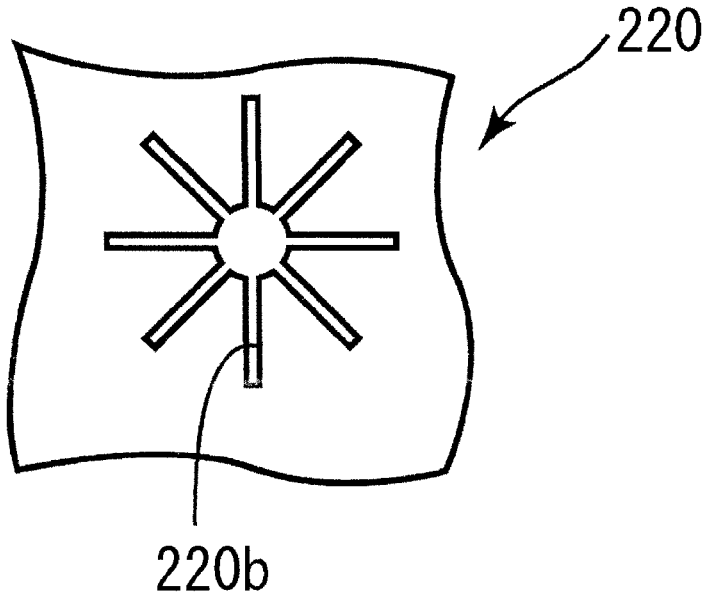
FIG. 7 is a plan view of a gas-generating layer of the fifth embodiment.

For example, as shown in FIG. 7, the plurality of grooves 220*b* are preferably formed radially extending from a part corresponding to the opening 214*a*. With this structure, it is possible to supply gases to the microchannel 214 from a wide area of the film-form photoresponsive gas-generating material.

Figure 8:
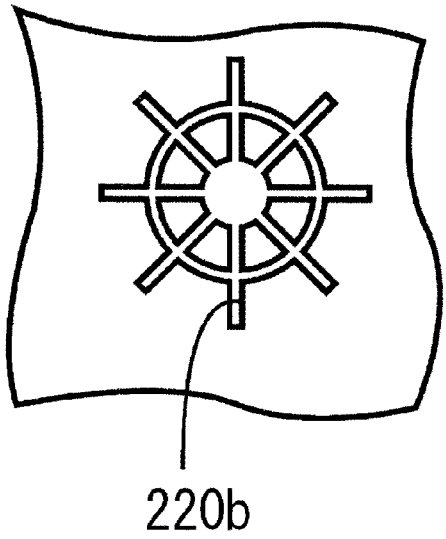
FIG. 8 is a plan view of a gas-generating layer in a modified example of the fifth embodiment.

Alternatively, as shown in FIG. 8, an annular zone-pattern or horseshoe-shaped groove may be further formed to connect the plurality of radially extending grooves 220*b*. It should be noted that the number and the shape of the grooves 220*b* are not limited at all in the present invention.

An opening formed to pass through the gas-generating layer 220 in the thickness direction may be formed instead of the grooves 220*b*.

The surface of the gas-generating layer 220 on the substrate 210 side may be roughened instead of forming the grooves 220*b* or the opening. Also in this case, it is possible to efficiently supply gases generated in a part distant from the opening 214*a* of the gas-generating layer 220 to the microchannel 214.

Figure 9:
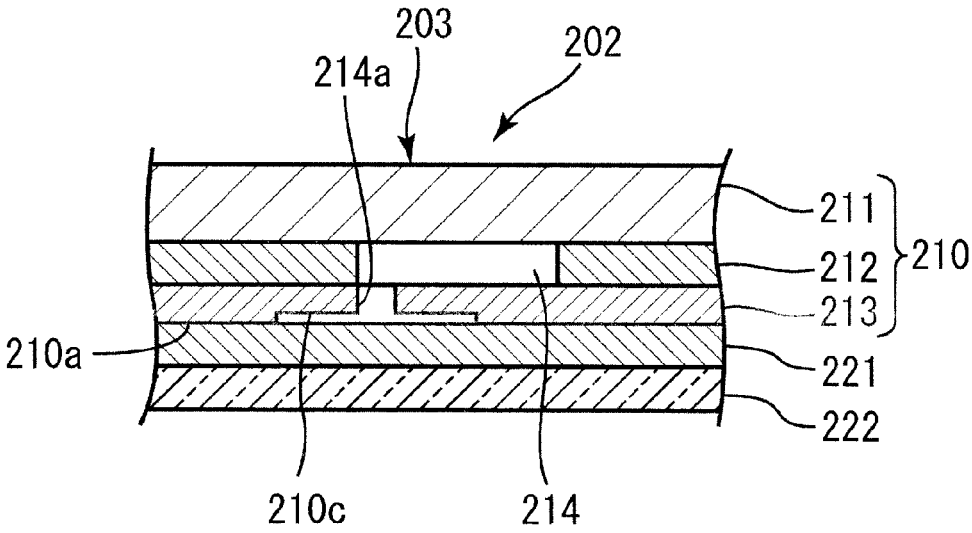
FIG. 9 is a cross-sectional view of a microfluid device of another modified example of the fifth embodiment.
Figure 10:
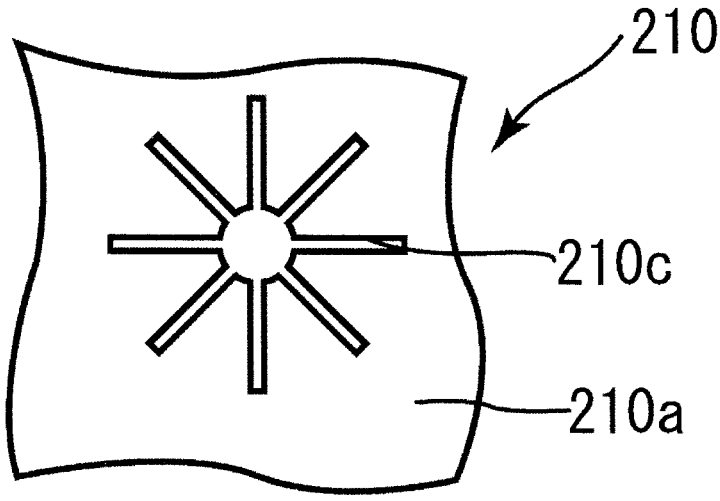
FIG. 10 is a plan view of the substrate in a still another modified example of the fifth embodiment.

As shown in FIGS. 9 and 10, grooves 210*c* may be formed on the surface 210*a* of the substrate 210 instead of forming the grooves 220*b* on the gas-generating layer 220 as described in the fifth embodiment. The grooves 220*b* may be formed on the gas-generating layer 220 and grooves 210*c* may be formed on the surface 210*a* of the substrate 210.

It is possible to more immediately supply gases to the microchannel by forming a plurality of the groove 210*c*, 220*b* and an opening, or roughening the surface of the substrate covered with the film-form photoresponsive gas-generating material, that is, forming depressions and projections on the surface of the substrate covered with the film-form photoresponsive gas-generating material.

The micropump of the present invention and the microfluid device provided with the micropump are not limited to the embodiments illustrated in the figures.

Hereinafter, the present invention is disclosed based on examples of the present invention and comparative examples. The present invention is not limited to the following examples.

EXAMPLES OF EXPERIMENT OF FIRST ASPECT OF THE INVENTION

Example 1

An amount of 35 parts by weight of 2,3,4,4'-tetrahydroxybenzophenone as a photo-sensitive acid-generating agent and 75 parts by weight of sodium hydrogen carbonate as an acid-sensitive gas-generating agent were mixed. The mixture was solidified by pressure and a tablet-form photoresponsive gas-generating material was obtained.

Example 2

A tablet-form photoresponsive gas-generating material was obtained in the same manner as in Example 1, except that 4.8 parts by weight of 2,4-dimethylthioxanthone as a photo-sensitizer was further blended with the composition mentioned in Example 1.

Example 3

An amount of 10 parts by weight of a mixed solvent (tetrahydrofuran:ethanol=1:1 in weight ratio) and 50 parts by weight of methyl methacrylate/acrylamide copolymers (methyl methacxrylate:acrylic amide=85:15 in copolymerization ratio (weight ratio), weight average molecular weight of 65500) were further blended with the composition mentioned in Example 2. The mixture was dried and a tablet-form photoresponsive gas-generating material was obtained.

Example 4

A tablet-form photoresponsive gas-generating material was obtained in the same manner as in Example 3, except that the amount of methyl methacrylate/acrylamide copolymers (methyl methacxrylate:acrylic amide=85:15 in copolymerization ratio (weight ratio), weight average molecular weight of 65500) was changed to 100 parts by weight.

Example 5

Spotting of the photoresponsive gas-generating material obtained in Example 3 in methanol as a poor solvent was carried out. The obtained droplets were dried and then recovered by a mesh, so that a fine-particle-form photoresponsive gas-generating material was obtained. The observation of the photoresponsive gas-generating material by using a scanning electron microscope (SEM) revealed that the particle size thereof was about 100 μm.

Example 6

The photoresponsive gas-generating material obtained in Example 3 was applied to a PET film by a casting method and then dried. Accordingly, a film-form photoresponsive gas-generating material was prepared. The thickness of the dried photoresponsive gas-generating film was about 100 μm.

Comparative Example 1

A photoresponsive gas-generating material was obtained in the same manner as in Example 2, except that 110 parts by weight of 2,2'-azobisisobutyronitrile was mixed as an azo compound instead of 35 parts by weight of 2,3,4,4'-tetrahydroxybenzophenone as a photo-sensitive acid-generating agent and 75 parts by weight of sodium hydrogen carbonate as an acid-sensitive gas-generating agent.

<Evaluations>

(Gas Yield)

A gas quantity measuring device was used, which was enclosed in UV transmitting silica glass and was equipped with a tube for conveying gas and a measuring pipet for measuring the gas quantity. The initial condition of the gas quantity measuring device was set by flowing water into the tube from one side to fill the measuring pipet with water to the baseline. This device was used to measure the water level change from the baseline, which was caused by gases generated in a chamber.

Each of the photoresponsive gas-generating materials obtained in Examples 1 to 6 and Comparative Example 1 was placed in the chamber of the gas quantity measuring device. The photoresponsive gas-generating material was irradiated with UV rays having a wavelength of 365 nm at the irradiation intensity of 24 mW/cm$^2$ (365 nm) by using a high-pressure mercury lamp. Then, the gas yield was measured. After 200 seconds from the start of irradiation of UV rays, the gas yield per gram of the azo compound and the gas yield from the total amount of the photo-sensitive acid-generating agent and the acid-sensitive gas-generating agent were measured. The obtained values were evaluated based on the below criteria (initial gas yield).

(Criteria of the Gas Yield)

◎: not less than 1.5 mL

○: not less than 1.0 mL and less than 1.5 mL

Δ: not less than 0.5 mL and less than 1.0 mL x: less than 0.5 mL

The results are shown in Table 1 below.

(Storage Stability)

Each of the photoresponsive gas-generating materials obtained in Examples 1 to 6 and Comparative Example 1 was placed in a dark room maintained at a temperature of 60° C. for a week. Then, the gas yield was measured in the same manner and compared with the initial gas yield.

○: no difference was found between the initial gas yield and the gas yield after the evaluation of storage stability.

x: The gas yield was reduced to 80% or less of the initial gas yield.

TABLE 1

| | Gas Yield | Storage Stability |
|---|---|---|
| Example 1 | Δ | ○ |
| Example 2 | ○ | ○ |
| Example 3 | ◎ | ○ |
| Example 4 | Δ | ○ |
| Example 5 | ◎ | ○ |
| Example 6 | ◎ | ○ |
| Comp. Ex. 1 | ○ | X |

With regard to Comparative Example 1 in which the azo compound was used, the gas yield after heating and storage was significantly lowered. As a result, the photoresponsive gas-generating material of Comparative Example 1 was found to have poor storage stability.

More specifically, the gas yield of Comparative Example 1 was 0.3 mL which was significantly lower than 0.5 mL or more of the gas yields obtained in Examples 1 to 3.

EXAMPLES OF EXPERIMENT OF SECOND ASPECT OF THE INVENTION

Synthesis Example of Photo-Sensitive Base-Generating Agent (A)

Synthesis Example 1

An amount of 20 g of ketoprofen (manufactured by Tokyo Chemical Industry Co., Ltd.) as a carboxylic acid (a1) represented by formula (2) and 7.8 g of ethylamine hydrochloride (manufactured by Wako Pure Chemical Industries, Ltd., Part Number: 213743) as a basic compound (a2) were mixed in ethanol. The mixture was stirred at room temperature for 24 hours so that a reaction occurred. The structure of the ethylamine hydrochloride is represented by formula (17).

[Chem. 23]

Formula (17)

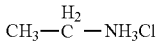

After ethanol was removed on the evaporator, the resulting crude product was recrystallized from ether/hexane. As a result, a photo-sensitive base-generating agent (A) was obtained.

Synthesis Example of Base Multiplier (B)

Synthesis Example 2

Synthesis of Base Multiplier Flu3

The base multiplier Flu3 represented by formula (12) was synthesized in the following order of (A) to (C).

(A) Synthesis of Fluorenylmethanol

Fluorenylmethanol was synthesized in accordance with formula (18).

[Chem. 24]

Formula (18)

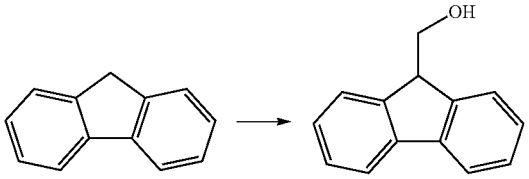

An amount of 60 g of fluorine was dissolved in 1500 ml of anhydrous THF. After a while, 225 ml of a 1.6 M solution of butyl lithium-hexane solution was slowly added dropwise thereto at 0° C. under argon gas atmosphere. Then, 12 g of paraformaldehyde was added and the mixture was stirred at room temperature for five hours. After the stirring, 600 ml of saturated sodium bicarbonate water was added and extracted with diethyl ether. The obtained organic phase was washed with saturated saline solution twice. The organic phase was dried with anhydrous magnesium sulfate, and then, the solvent was removed. The obtained paste-like solid was recrystallized from a mixed solvent of hexane and ethanol. As a result, 50 g of fluorenylmethanol was obtained as a white needle crystal. Measurement by $^1$H-NMR confirmed that the structure of the obtained compound was represented by formula (18). The melting point and the measurement result by $^1$H-NMR are shown below.

Yield: 71%

Melting point: 98 to 101° C.

$^1$H-NMR (270 MHz, $CDCl_3$) δ (ppm): 1.71 (1H, s, OH), 3.6-4.3 (3H, m, CH, $CH_2$), 7.2-7.5 (4H, m, ArH), 7.54 (2H, d, J=7.3 Hz, ArH), 7.73 (2H, d, J=7.3 Hz, ArH)

(B) Synthesis of Acrylate Monomer

An acrylate monomer was synthesized in accordance with formula (19).

[Chem. 25]

Formula (19)

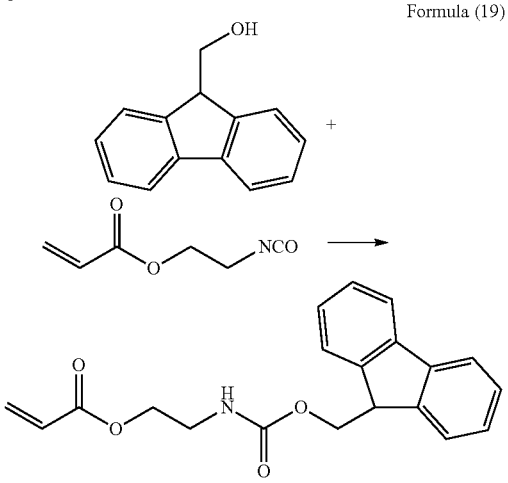

An amount of 60 ml of dehydrobenzene and 100 mg of di-n-butyltin dilaurylate as a catalyst were added to 2.08 g (10.6 mmol) of fluorenylmethanol synthesized in accordance with formula (18). Subsequently, 1.41 g (10 mmol) of 2-isocyanatoethyl acrylate and 20 ml of benzene solution containing 50 mg of 2,6-di-tert-butyl-p-cresol as a polymerization inhibitor were added dropwise thereto under reflux. After reflux for nine hours, the mixture was cooled to room temperature and the solvent was removed therefrom. A small amount of diethyl ether and a large amount of hexane was added to the obtained brown oil. The mixture was kept in a freezer to be recrystallized, and acrylate monomer was obtained as a white crystal. Measurement by $^1$H-NMR confirmed that the structure of the obtained compound was represented by formula (19). The melting point and the measurement result by $^1$H-NMR are shown below.

Yield: 71%

Melting point: 101 to 103° C.

$^1$H-NMR (270 MHz, $CDCl_3$) δ (ppm): 3.3-3.7 (2H, m, NH—$CH_2$), 4.0-4.6 (4H, m, O—$CH_2$), 5.06 (1H, s, NH), 5.85 (1H, d, 6.0-6.2 (1H, m, C—CH), 6.44 (1H, d, J=17.0 Hz, C═$CH_2$), 7.1-7.5 (4H, m, ArH), 7.57 (2H, d, J=7.3 Hz, ArH), 7.76 (2H, d, J=7.3 Hz, ArH)

(C) Synthesis of Base Multiplier Flu3

A base multiplier Flu3 was synthesized in accordance with formula (20).

[Chem. 26]

Formula (20)

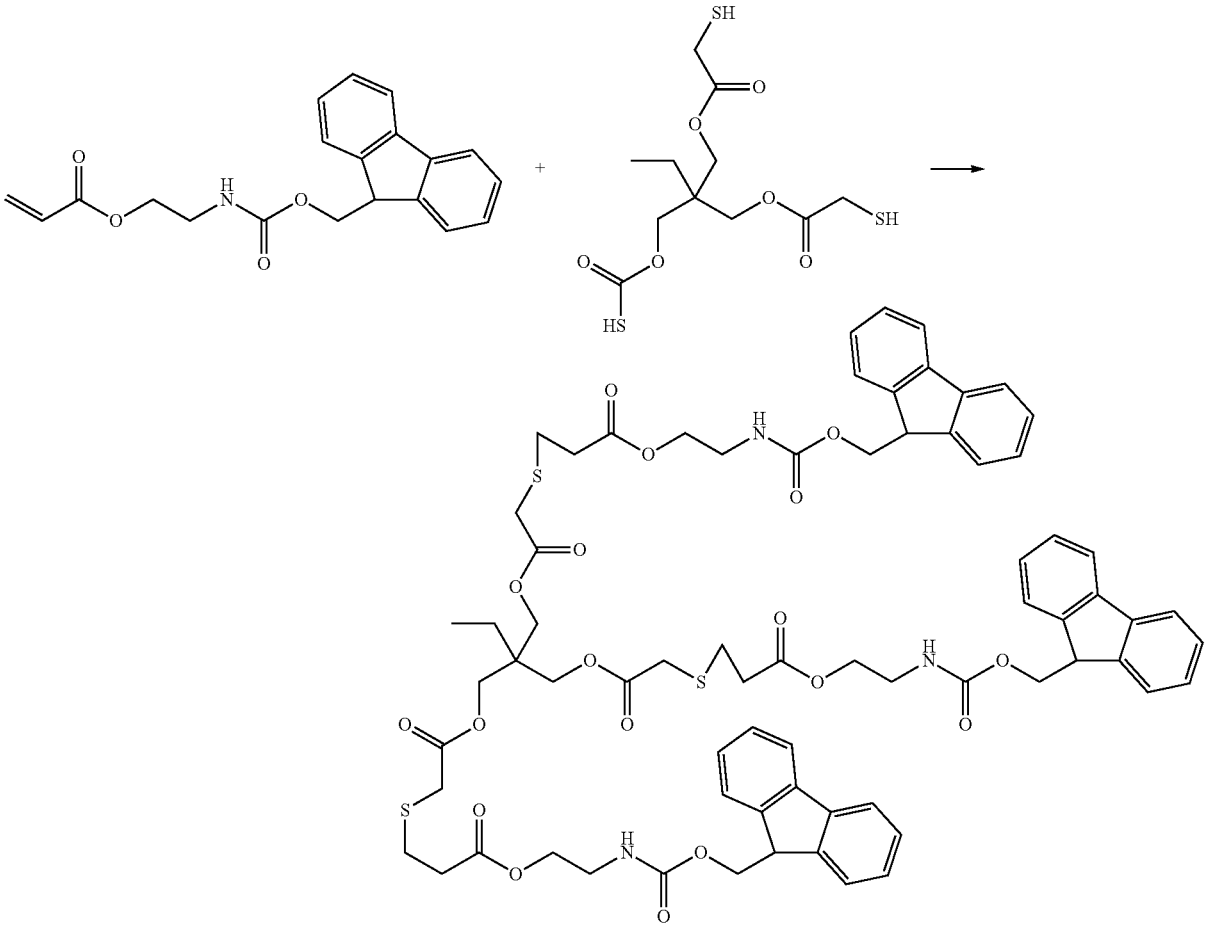

Flu 3

An amount of 0.36 g (1.0 mmol) of the acrylate monomer synthesized in accordance with formula (19), 1.0 g (3.0 mmol) of TMTG (trithiol derivative), and 19 mg (0.1 mmol) of tri-n-butylamine as a catalyst were dissolved in 7 ml of anhydrous dichloromethane. The mixture was stirred at room temperature for four days. After the stirring, the mixture was washed with 2M hydrochloric acid and then with saturated saline solution. The resulting product was dried with anhydrous magnesium sulfate. Subsequently, the oil obtained after removal of the solvent in vacuo was frozen in a freezer. As a result, Flu3 was obtained. Measurement by $^1$H-NMR and MALDI confirmed that the structure of the obtained compound was represented by formulas (12) and (20). The measurement results by $^1$H-NMR and MALDI are shown below.

<Flu3>

Colorless Oil

Yield: 89%

$^1$H-NMR (270 MHz, $CDCl_3$) δ (ppm): 0.8-1.2 (3H, m, $CH_3$), 1.4-1.6 (2H, m, $CH_2$), 2.5-2.8 (6H, m, $CH_2$), 2.8-3.1 (6H, m, $CH_2$), 3.2-3.6 (12H, m, $CH_2$), 4.0-4.6 (18H, m, $CH_2$), 5.2-5.5 (3H, m, NH), 7.2-7.5 (12H, m, ArH), 7.58 (6H, d, J=7.3 Hz, ArH), 7.74 (6H, d, J=7.3 Hz, ArH)

MALDI (m/z): 1390.1 $(M+Na)^+$), 1406.1 $(M+K)^+$)

Example 7

An amount of 100 parts by weight of the photo-sensitive base-generating agent (A) obtained in Synthesis example 1 and 60 parts by weight of the base multiplier (B) (Flu3) and 100 parts by weight of N,N-diethylethylenediamine (manufactured by Sigma-Aldrich Co., Part number: 112720) as an aminoalkyl compound (C) were stirred in 260 parts by weight of ethanol. As a result, a composition for a photoresponsive gas-generating material was obtained. The composition was attached to the surface of a nonwoven (manufactured by Asahi Kasei Corporation, Trade name: Bencotton) having a thickness of 1 mm and dried in a dark place. After drying, the compound was cut together with the nonwoven into a square (50×50 mm) in the plane. Thus, a square photoresponsive gas-generating material comprising a square nonwoven in the plane with a photoresponsive gas-generating material supported thereon was obtained.

Example 8

The photoresponsive gas-generating material in Example 7 was solidified by pressure and a tablet-form photoresponsive gas-generating material was obtained.

Example 9

A composition for photoresponsive gas-generating material was obtained in the same manner as in Example 7, except that 4.8 parts by weight of 2,4-dimethylthioxanthone (manufactured by Nippon Kayaku Co., Ltd., Part number: Kayacure DETX) as a photosensitizer was further added to the components for obtaining the composition. Then, a square photoresponsive gas-generating material having a size of 50×50 mm in the plane was produced in the same manner as in Example 7.

Example 10

An amount of 50 parts by weight of methyl methacrylate/acrylamide copolymer (methyl methacrylate:acrylamide=60:40 in a weight ratio, weight average molecular weight of 65500) as a binder resin (D), 4.8 parts by weight of 2,4-dimethylthioxanthone (manufactured by Nippon Kayaku Co., Ltd., Part number: Kayacure DETX) as a photosensitizer (E), and 50 parts by weight of the solid component in Example 6 were dissolved in 100 parts by weight of a mixed solvent containing tetrahydrofuran and ethanol at the weight ratio of 1:1. Thus, a composition for a photoresponsive gas-generating material was obtained. Then, a photoresponsive gas-generating material was obtained in the same manner as in Example 7.

Example 11

An amount of 100 parts by weight of hexamminecobalt (III) hydrochloride (manufactured by Wako Pure Chemical Industries, Ltd., Part Number: 080-07362) as a photo-sensitive base-generating agent (A), 60 parts by weight of the base multiplier (B) (Flu3) obtained in Synthesis example 2, 100 parts by weight of methylamine hydrochloride (manufactured by Wako Pure Chemical Industries, Ltd., Part Number: P-624N) as an aminoalkyl compound (C), and 50 parts by weight of methyl methacrylate/acrylamide copolymer (weight average molecular weight of 65500) as a binder (D) were stirred in 260 parts by weight of ethanol. As a result, a composition for a photoresponsive gas-generating material was obtained. From this composition for a photoresponsive gas-generating material, a photoresponsive gas-generating material was obtained and then evaluated in the same manner as in Example 7.

Example 12

A composition for a photoresponsive gas-generating material was obtained in the same manner as in Example 11, except that 100 parts by weight of o-nitrobenzyl carbamate synthesized as below as a photo-sensitive base-generating agent (A) and ethylamine hydrochloride (manufactured by Wako Pure Chemical Industries, Ltd., Part number: 2137) as an aminoalkyl compound (C) were used. Further, in the same manner as in Example 7, a photoresponsive gas-generating material was obtained and then evaluated.

Synthesis of o-nitrobenzyl carbamate

An amount of 3.90 g of o-nitrobenzyl alcohol and 0.12 g of dibutyltin laurate were dissolved in 32 mL of benzene. A solution in which 2.92 g of 3-isocyanate propyltriethoxysilane was dissolved in 24 mL of benzene was added dropwise to this solution while being stirred at 60° C. After the dropwise addition, the solution was stirred for five hours and the solvent was removed therefrom in vacuo. Consequently, light yellow liquid was obtained. The obtained liquid was purified by column chromatography (silicagel as filler, hexane:ethylacetate:TEOS=75:25:1 (v/v) as developing solvent 1, hexane:ethylacetate=3:1 (v/v) as developing solvent 2). As a result, 6.67 g of N-(3-triethoxysilylpropyl)o-nitrobenzyl carbamate ester was obtained as light yellow liquid.

1H-NMR ($CDCl_3$) δ (ppm): 0.65 (2H, t, J=8.1 Hz, SiCH2), 1.23 (9H, t, J=6.9 Hz, Si(OCH2CH3)3), 1.66 (2H, quin, J=7.4 Hz, CH2CH2CH2), 3.22 (2H, q, J=6.6 Hz, CH2NH), 3.83 (6H, q, J=6.9 Hz, Si(OCH2CH3)3), 5.28 (1H, t, J=4.8 Hz, NHCO), 5.50 (2H, s, COOCH2), 8.09-7.44 (4H, m, Ar—H), 29Si—NMR (CDCl3) δ (ppm): −45.624

IR (neat) (cm-1): 3334 (N—H), 1713 (C—O), 1527 (N—H)

Element analysis value: 51.12% of C, 6.94% of H, 6.79% of N

Calculation value as C17H28N2O7Si: 50.9% of C, 7.05% of H, 7.00% of N

Example 13

A composition for a photoresponsive gas-generating material was obtained in the same manner as in Example 11, except that a photo-sensitive base-generating agent having a structure represented by formula (1) as a photo-sensitive base-generating agent (A) and butylamine hydrochloride (manufactured by Wako Pure Chemical Industries, Ltd., Part Number: 024-0340) as an aminoalkyl compound (C) were used. Further, in the same manner as in Example 7, a photoresponsive gas-generating material was obtained and then evaluated.

Example 14

A composition for a photoresponsive gas-generating material was obtained in the same manner as in Example 11, except that the same material as in Example 7 as a photo-sensitive base-generating agent (A) and N,N-diethylethylenediamine (Cw) as an aminoalkyl compound (C) were used. Further, in the same manner as in Example 7, the obtained material was evaluated.

Examples 15 to 23

A composition for a photoresponsive gas-generating material was obtained in the same manner as in Example 14, except that the blending amounts of the base multiplier (B) in Examples 15 to 17 were changed as shown in Table 3 below. Further, in the same manner as in Example 7, the obtained material was evaluated.

A composition for a photoresponsive gas-generating material was obtained in the same manner as in Example 14, except that the blending amounts of methyl methacrylate/acrylamide copolymer as a binder (D) in Examples 15 to 17 were changed as shown in Table 3 below. Further, in the same manner as in Example 7, the obtained material was evaluated.

A composition for a photoresponsive gas-generating material was obtained in the same manner as in Example 14, except that the blending amounts of methyl methacrylate/acrylamide copolymer as a binder (D) in Examples 21 to 23 were changed as shown in Table 3 below. Further, in the same manner as in Example 7, the obtained material was evaluated.

Comparative Example 2

An amount of 100 parts by weight of hydrolyzable silyl group-containing polypropylene glycol (manufactured by Asahi Glass Co., Ltd., Trade name: Excestar ESS-2410) and 2 parts by weight of dibutyltin dilaurate (manufactured by Wako Pure Chemical Industries, Ltd.) were mixed uniformly, so that a composition for a photoresponsive gas-generating material was obtained. The obtained composition was injected into a space (50 mm×50 mm×3 mm) in the frame made of polymethyl methacrylate (PMMA) and cured in the air for 12 hours. The cured product was removed from the frame as a gas-generating material.

Evaluation of Example and Comparative Example

The photoresponsive gas-generating material was evaluated by measuring the gas yield of the manufactured photoresponsive gas-generating material irradiated with UV rays. Here, a gas quantity measuring device was used, which was equipped with a gas-generating chamber enclosed in UV-transmitting silica glass, a tube connected to the gas-generating chamber for draining gases generated therein, and a measuring pipet connected to the tube for measuring the quantity of the generated gases. The size of the gas-generating chamber was 50 mm×50 mm×3 mm. The initial condition of the gas quantity measuring device was set by flowing water into the tube from one side to fill the measuring pipet with water to the baseline. Subsequently, the one side of the tube was connected to the gas-generating chamber and the water level changed by the gases generated in the gas-generating chamber was measured. Based on the measurement, the gas yield was determined.

Each of the photoresponsive gas-generating materials obtained in Examples and Comparative example was placed in the gas-generating chamber. The photoresponsive gas-generating material was irradiated with UV rays having a wavelength of 380 nm at the irradiation intensity of 24 mW/cm$^2$ by using a high-pressure mercury lamp. Then, the amount of the gases generated from the photoresponsive gas-generating material was measured. Based on the measurement, the gas yield per gram of the photoresponsive gas-generating material was obtained and the obtained value was evaluated based on the below criteria.

Criteria of the Gas Yield

◎: not less than 1.5 mL

○: not less than 1.0 mL and less than 1.5 mL

Δ: not less than 0.5 mL and less than 1.0 mL x: less than 0.5 mL

The results are shown in Tables 2 and 3 below.

TABLE 2

| | A (Photo-sensitive base-generating agent) | B (Base multiplier) | C (Aminoalkyl compound) | D (Binder resin) | E (Photosensitizer) | Evaluation |
|---|---|---|---|---|---|---|
| Ex. 7 | Photo-sensitive base-generating agent (A) (100 parts by weight) | Flu3 (60 parts by weight) | Cw (100 parts by weight) | — | — | Δ |
| Ex. 8 | The composition for a photoresponsive gas-generating material in Example 7 was solidified by pressure and a tablet-form photoresponsive gas-generating material was obtained. | | | | | |
| Ex. 9 | Photo-sensitive base-generating agent (A) (100 parts by weight) | Flu3 (60 parts by weight) | Cw (100 parts by weight) | — | 2,4-dimethylthioxanthone (4.8 parts by weight) | ○ |
| Ex. 10 | Photo-sensitive base-generating agent (A) (100 parts by weight) | Flu3 (60 parts by weight) | Cw (100 parts by weight) | D1 (average molecular weight: 65500) (50 parts by weight) | 2,4-dimethylthioxanthone (4.8 parts by weight) | ◎ |
| Comp. Ex. 2 | 100 parts by weight of hydrolyzable silyl group-containing polypropylene glycol | | | | | X |

TABLE 2-continued

| | A (Photo-sensitive base-generating agent) | B (Base multiplier) | C (Aminoalkyl compound) | D (Binder resin) | E (Photosensitizer) | Evaluation |
|---|---|---|---|---|---|---|
| | (manufactured by Asahi Glass Co., Ltd., Trade name: Excestar ESS-2410) and 2 parts by weight of dibutyltin laurate (manufactured by Wako Pure Chemical Industries, Ltd.) | | | | | |

(A): a1 + a2
Cw: N,N-diethyl ethylene diamine
D1: Methyl methacrylate/acrylamide copolymer

TABLE 3

| | A (Photo-sensitive base-generating agent) | B (Base multiplier) | C (Aminoalkyl compound) | D (Binder resin) | E (Photo-sensitizer) | Evaluation |
|---|---|---|---|---|---|---|
| Ex. 11 | Ax (100 parts by weight) | Flu3 (60 parts by weight) | Cx (100 parts by weight) | D1 (Average molecular weight: 65500) (50 parts by weight) | 0 | ○ |
| Ex. 12 | Ay (100 parts by weight) | Flu3 (60 parts by weight) | Cy (100 parts by weight) | D1 (Average molecular weight: 65500) (50 parts by weight) | 0 | ○ |
| Ex. 13 | Az (100 parts by weight) | Flu3 (60 parts by weight) | Cz (100 parts by weight) | D1 (Average molecular weight: 65500) (50 parts by weight) | 0 | ◎ |
| Ex. 14 | Photo-sensitive base-generating agent (A) (100 parts by weight) | Flu3 (60 parts by weight) | Cw (100 parts by weight) | D1 (Average molecular weight: 65500) (50 parts by weight) | 0 | ◎ |
| Ex. 15 | Photo-sensitive base-generating agent (A) (100 parts by weight) | Flu3 (240 parts by weight) | Cw (100 parts by weight) | D1 (Average molecular weight: 65500) (50 parts by weight) | 0 | ◎ |
| Ex. 16 | Photo-sensitive base-generating agent (A) (100 parts by weight) | Flu3 (6 parts by weight) | Cw (100 parts by weight) | D1 (Average molecular weight: 65500) (50 parts by weight) | 0 | Δ |
| Ex. 17 | Photo-sensitive base-generating agent (A) (100 parts by weight) | Flu3 (360 parts by weight) | Cw (100 parts by weight) | D1 (Average molecular weight: 65500) (50 parts by weight) | 0 | ◎ |
| Ex. 18 | Photo-sensitive base-generating agent (A) (100 parts by weight) | Flu3 (60 parts by weight) | Cw (100 parts by weight) | D1 (Average molecular weight: 65500) (10 parts by weight) | 0 | Δ |
| Ex. 19 | Photo-sensitive base-generating agent (A) (100 parts by weight) | Flu3 (60 parts by weight) | Cw (100 parts by weight) | D1 (Average molecular weight: 65500) (450 parts by weight) | 0 | ○ |
| Ex. 20 | Photo-sensitive base-generating agent (A) (100 parts by weight) | Flu3 (60 parts by weight) | Cw (100 parts by weight) | D1 (Average molecular weight: 65500) (600 parts by weight) | 0 | Δ |
| Ex. 21 | Photo-sensitive base-generating agent (A) (100 parts by weight) | Flu3 (60 parts by weight) | Cw (100 parts by weight) | D1 (Average molecular weight: 500000) (50 parts by weight) | 0 | ◎ |
| Ex. 22 | Photo-sensitive base-generating agent (A) (100 parts by weight) | Flu3 (60 parts by weight) | Cw (100 parts by weight) | D1 (Average molecular weight: 10000) (50 parts by weight) | 0 | Δ |
| Ex. 23 | Photo-sensitive base-generating agent (A) (100 parts by weight) | Flu3 (60 parts by weight) | Cw (100 parts by weight) | D1 (Average molecular weight: 1000000) (50 parts by weight) | 0 | Δ |

(A): a1 + a2
Ax: Hexamminecobalt(III) hydrochloride (manufactured by Wako Pure Chemical Industries, Ltd., Part Number: 080-07362)
Ay: o-nitrobenzyl carbamate
Az: Compound represented by formula (1)
Cx: Methylamine hydrochloride (manufactured by Wako Pure Chemical Industries, Ltd., Part Number: P-624N)
Cy: Ethylamine hydrochloride (manufactured by Wako Pure Chemical Industries, Ltd., Part Number: 213743)
Cz: Butylamine hydrochloride (manufactured by Wako Pure Chemical Industries, Ltd., Part Number: 024-03403)
Cw: N,N-diethyl ethylene diamine
D1: Methyl methacrylate/acrylamide copolymer

Example 24

Example of a Microfluid Device

Micromachining by a gaslaser was performed on an acrylic resin plate (60 mm×20 mm×1 mm) to form a microchannel having the size of 40 mm in length, 0.2 mm in width, and 0.2 μm in depth on the surface. A solution container (0.5 mm×0.5 mm×0.2 mm) was formed at the position 10 mm from the starting point of the channel and a circular through hole having the diameter of 1 mm was formed at the starting point of the channel. In the part wherein the through hole was formed, a circular depression having the diameter of 20 mm was formed on the surface opposite to the surface having the microchannel formed thereon. Another acrylic resin plate was bonded to the surface of the above acrylic resin plate, on which the microchannel was formed. Thus, the microchannel was sealed to obtain a microfluid device.

A composition for a photoresponsive gas-generating material was obtained in the same manner as in Example 9, except that 20 parts by weight of methyl methacrylate (manufactured by Wako Pure Chemical Industries, Ltd.) as an adhesive binder was further added to the materials for a composition for a photoresponsive gas-generating material prepared in Example 9. The composition for a photoresponsive gas-generating material was applied to a corona-treated polyethylene terephthalate film (manufactured by TOYOBO CO., LTD., Product name: TOYOBO Cosmoshine A4100) by using an applicator (manufactured by Coating Tester Industries Co., Ltd.) in such a manner that the dried film has a thickness of 50 μm. Subsequently, a mold-released polyethylene terephthalate film (manufactured by Lintec Corporation, Part Number: #5011) was attached to a layer of the dried component for a photoresponsive gas-generating material as a protection film. Thus, a film-form photoresponsive gas-generating material sandwiched between two PET films was obtained. Removal of a PET film on one side exposed the film-form photoresponsive gas-generating material. The film-form photoresponsive gas-generating material was attached to the surface of the acrylic resin plate, on which the circular recess was formed, in such a manner to cover the circular depression.

Comparative Example 3

An amount of 20 parts by weight of methyl methacrylate as the adhesive binder element used in Example 24 was blended with the composition for a photoresponsive gas-generating material of Comparative Example 2. A film-form photoresponsive gas-generating material was prepared in the same manner as in Example 22, and then, a microfluid device was formed in the same manner as in Example 22.

Evaluation of Example 24 and Comparative Example 3

In each of the microfluid devices obtained in Example 24 and Comparative Example 3, the photoresponsive gas-generating material was irradiated with UV rays having a maximum wavelength peak of 380 nm at the irradiation intensity of 20 mW/cm$^2$ by using a LED, so that gases were generated. Then, the movement of the microfluid in the microdevice was evaluated. More specifically, before attachment of the photoresponsive gas-generating material to an acrylic resin plate, phosphate buffer solution colored with red food coloring was added through the above-mentioned through hole until the solution container was completely filled. The flow of the phosphate buffer solution was recorded on video from the start of irradiation until the completion of the drainage. The recorded video was analyzed on Motion DV studio 5.6J for DV (manufactured by Panasonic Corporation). The results are shown in Table 4 below. It is to be noted that Table 4 shows the result in the case of Sample number n=5.

TABLE 4

| | Time Until the Solution Starts to Move (second) | Moving Speed |
|---|---|---|
| Example 24 | 5 ± 1 | 25 ± 3 mm/s |
| Comp. Example 3 | 90 ± 30 | 0.5 ± 1 mm/s |

In Example 24, gases were generated and the movement of the solution started much sooner, compared to the case of Comparative Example 3. Since gases were generated efficiently in Example 24, timing of the solution's movement did not vary so much. Since gases were not generated efficiently in Comparative Example 3, time was required until the solution started to move and the timing of the solution's movement varied.

As above described, in Example 24, a simple attachment of a film-form photoresponsive gas-generating material to one surface of an acrylic resin plate, on which a microchannel is formed can easily configure a micropump in the microfluid device.

The invention claimed is:

1. A photoresponsive gas-generating material in a micropump of a microfluid device having a fine channel formed in a substrate, comprising: at least one photo-sensitive base-generating agent (A) selected from the group consisting of cobalt amine complexes, o-nitrobenzyl carbamate, oxime esters, carbamoyloxy imino group-containing compounds capable of generating an amine in response to light irradiation and represented by formula (1):

Formula (1)

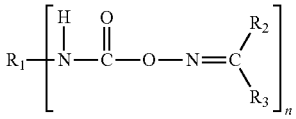

wherein $R_1$ represents an n-valent organic group; $R_2$ and $R_3$ individually represent a hydrogen, an aromatic group, or an aliphatic group, and may be the same as or different from each other; and n is an integer of 1 or more, and salts of carboxylic acids (al) represented by formula (2) and basic compounds (a2); and a base multiplier (B)

Formula (2)

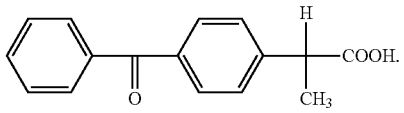

2. The photoresponsive gas-generating material according to claim 1, wherein the photoresponsive gas-generating material comprises 50 to 200 parts by weight of the base multiplier with respect to 100 parts by weight of the photo-sensitive base-generating agent.

3. The photoresponsive gas-generating material according to claim 1 or 2, further comprising an amino alkyl compound (C).

4. The photoresponsive gas-generating material according to claim 1 or 2, further comprising a binder resin.

5. The photoresponsive gas-generating material according to claim 2, wherein the photoresponsive gas-generating material comprises 20 to 500 parts by weight of the photo-sensitive base-generating agent (A) and 10 to 1,000 parts by weight of the base multiplier (B) with respect to 100 parts by weight of the binder resin.

6. The photoresponsive gas-generating material according to claim 1, which is in a tablet, fine particle or film form.

7. A photoresponsive gas-generating part, comprising: the photoresponsive gas-generating material according to claim 1; and a supporting member for supporting said photoresponsive gas-generating material.

8. A micropump to be used in a microfluid device having a fine channel formed in a substrate, comprising, in said micropump, at least one selected from the group consisting of the photoresponsive gas-generating material according to claim 1, a photoresponsive gas-generating tablet made of said photoresponsive gas-generating material, a photoresponsive gas-generating fine particulate material made of said photoresponsive gas-generating material, and a photoresponsive gas-generating film made of said photoresponsive gas-generating material.

9. The micropump according to claim 7, wherein a gas-generating chamber defining said micropump is provided in said substrate, an optical window is provided on one of said substrate to face the gas-generating chamber, and said photoresponsive gas-generating material is housed in said gas-generating chamber.

10. A micropump, wherein said micropump comprises the photoresponsive gas-generating material according to claim 1 is in a film form, a gas-generating unit having an opening on a surface of a substrate is provided on said substrate to define the micropump, and said film-form photoresponsive gas-generating material is attached on the surface of said substrate so that said gas-generating unit is sealed with said film-form photoresponsive gas-generating material.

11. A microfluid device, having a fine channel formed in a substrate, wherein said microfluid device comprises: a first plate having at least two of said micropumps built in said substrate; and a second plate laminated on said first plate and having a groove or a through hole to constitute a fine channel, and said micropump has the photoresponsive gas-generating material according to claim 1 as a driving source.

12. The microfluid device according to claim 11, wherein the photoresponsive gas-generating material has a plurality of said fine channels, and further comprises a light shielding layer extending over openings of said fine channels adjacent to each other in a plain view and shielding said gas-generating unit from light.

* * * * *